US007669262B2

(12) United States Patent
Skripps et al.

(10) Patent No.: US 7,669,262 B2
(45) Date of Patent: Mar. 2, 2010

(54) ACCESSORY FRAME FOR SPINAL SURGERY

(75) Inventors: Thomas K. Skripps, Acton, MA (US); George T. Wong, Chelmsford, MA (US); Paul A. Licari, Boxborough, MA (US); David Warburton, Lexington, MA (US); Edward J. Daley, II, Maynard, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 661 days.

(21) Appl. No.: 11/402,330

(22) Filed: Apr. 11, 2006

(65) Prior Publication Data

US 2006/0242765 A1 Nov. 2, 2006

Related U.S. Application Data

(63) Continuation-in-part of application No. 11/229,759, filed on Sep. 19, 2005.

(60) Provisional application No. 60/670,027, filed on Apr. 11, 2005, provisional application No. 60/720,598, filed on Sep. 26, 2005, provisional application No. 60/670,041, filed on Apr. 11, 2005, provisional application No. 60/670,040, filed on Apr. 11, 2005, provisional application No. 60/626,627, filed on Nov. 10, 2004.

(51) Int. Cl.
*A47B 13/00* (2006.01)

(52) U.S. Cl. ..... 5/621; 5/624

(58) Field of Classification Search ..... 5/621–624, 5/81.1 R, 11

See application file for complete search history.

(56) References Cited

U.S. PATENT DOCUMENTS 2,509,086 A 5/1950 Eaton
3,015,113 A * 1/1962 Wallen ..... 5/11
3,042,025 A 7/1962 Jackson (Continued)

FOREIGN PATENT DOCUMENTS

WO 2005/020819 A1 3/2005

OTHER PUBLICATIONS

"2005 Catalog Passionate About Positioning", Allen Medical Systems, A Hill-Rom Company; ©, date Dec. 2004.

(Continued)

*Primary Examiner*—Fredrick Conley
(74) *Attorney, Agent, or Firm*—Barnes & Thornburg LLP

(57) ABSTRACT

An accessory has a substantially radiolucent frame, a floor-supported base, and a support structure extending between the base and one end of the frame. A second end of the frame is coupleable to a surgical table in a manner that permits the frame to articulate relative to the surgical table. The support structure is extendable and retractable to change the height at which the first end of the frame is supported above the base. The support structures is able to tilt front to rear and side to side relative to the base and the frame is able to tilt front to rear and side to side relative to the support structure. The frame is movable to a compact storage position having the second end of the frame supported on the base. A set of wheels are provided on the base to permit the accessory to be wheeled from one location to another.

36 Claims, 18 Drawing Sheets

U.S. PATENT DOCUMENTS 3,099,441 A 7/1963 Ries
3,188,079 A 6/1965 Boetker et al.
3,493,225 A 2/1970 Ceraldi
3,828,377 A 8/1974 Fary, Sr.
3,947,686 A 3/1976 Cooper et al.
4,018,412 A 4/1977 Kees, Jr. et al.
4,054,282 A * 10/1977 Hamer ..... 5/610
4,108,426 A 8/1978 Lindstroem et al.
4,139,917 A 2/1979 Fenwick
4,225,125 A 9/1980 Lee
4,239,200 A 12/1980 Sarrafian et al.
4,391,438 A 7/1983 Heffington, Jr.
4,474,364 A 10/1984 Brendgord
4,484,911 A 11/1984 Berlin et al.
4,506,872 A 3/1985 Westerberg et al.
4,526,355 A 7/1985 Moore et al.
4,527,555 A 7/1985 Ruf
4,527,787 A 7/1985 Collis, Jr.
4,558,857 A 12/1985 Heller
4,562,588 A 12/1985 Ruf
4,616,813 A 10/1986 McConnell
4,635,914 A 1/1987 Kabanek
4,653,482 A 3/1987 Kurland
4,662,619 A 5/1987 Ray et al.
4,671,728 A 6/1987 Clark et al.
4,712,781 A 12/1987 Watanabe
4,840,363 A 6/1989 McConnell
4,852,840 A 8/1989 Marks
4,872,656 A 10/1989 Brendgord et al.
4,923,187 A 5/1990 Mombrinie
4,989,848 A 2/1991 Monroe
4,995,067 A * 2/1991 Royster et al. ..... 378/177
5,088,706 A 2/1992 Jackson
5,131,106 A 7/1992 Jackson
5,276,927 A 1/1994 Day
5,444,882 A 8/1995 Andrews et al.
5,535,466 A 7/1996 Snell
5,613,254 A 3/1997 Clayman et al.
5,628,078 A 5/1997 Pennington et al.
5,655,238 A 8/1997 Stickley et al.
5,658,315 A 8/1997 Lamb et al.
5,675,851 A 10/1997 Feathers
5,741,210 A 4/1998 Dobrovolny
5,758,374 A 6/1998 Ronci
5,926,876 A 7/1999 Haigh et al.
6,001,076 A 12/1999 Wilson et al.
6,003,174 A 12/1999 Kantrowitz et al.
6,120,397 A 9/2000 Julian
6,195,820 B1 3/2001 Heimbrock et al.
6,199,233 B1 3/2001 Kantrowitz et al.
6,199,552 B1 3/2001 Crespo
6,237,172 B1 5/2001 Morgan, Sr.
6,260,220 B1 7/2001 Lamb et al.
6,295,671 B1 10/2001 Reesby et al.
6,336,412 B2 1/2002 Heimbrock et al.
6,490,737 B1 12/2002 Mazzei et al.
6,526,609 B2 3/2003 Wong
6,557,195 B2 5/2003 Dinkler
6,584,630 B1 7/2003 Dinkler
6,754,923 B2 6/2004 Borders et al.
6,813,788 B2 11/2004 Dinkler et al.
7,520,008 B2 4/2009 Wong et al.
2002/0032927 A1 * 3/2002 Dinkler
2002/0061255 A1 5/2002 Boucher et al.
2004/0123389 A1 7/2004 Boucher et al.
2004/0133979 A1 7/2004 Newkirk et al.
2004/0133983 A1 7/2004 Newkirk et al.

OTHER PUBLICATIONS

"2002 Catalog Advanced Orthopedic Technology", Ronci*Surgical; ©, date 2002.

* cited by examiner

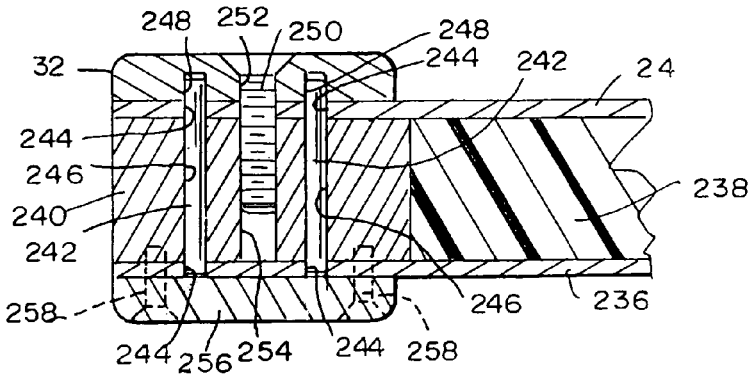
FIG. 18
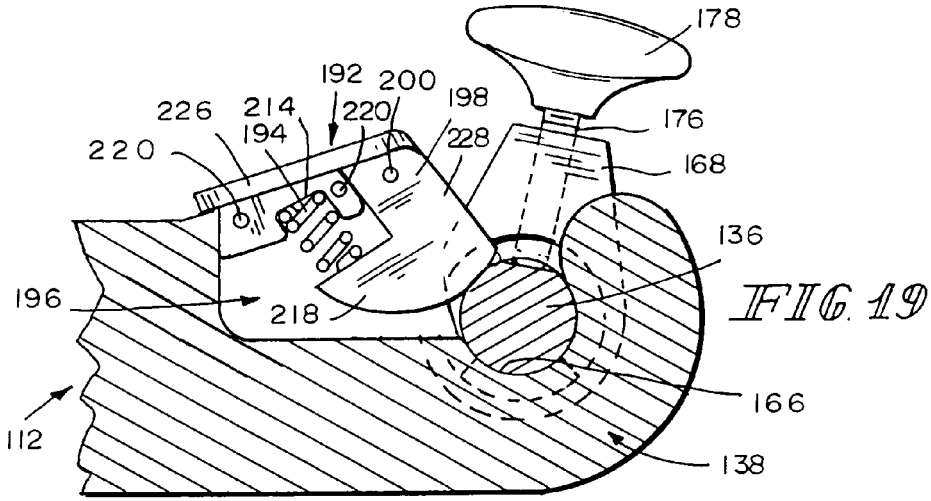
FIG. 19
FIG. 20
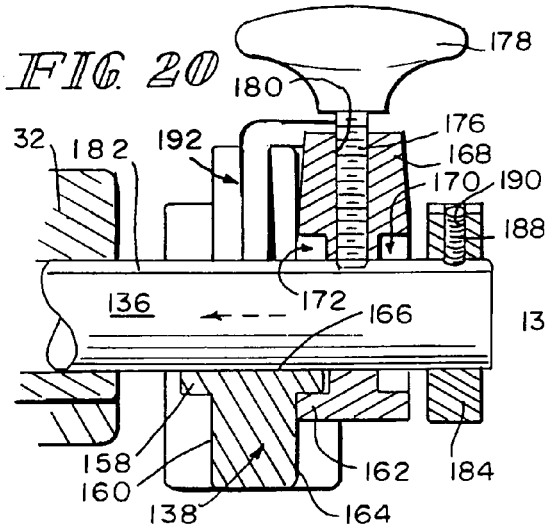
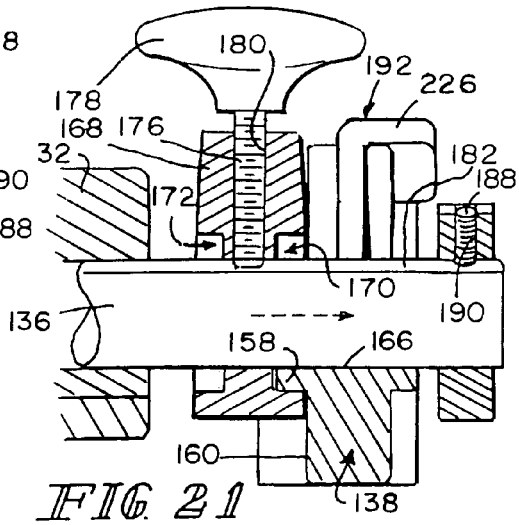
FIG. 21

ACCESSORY FRAME FOR SPINAL SURGERY

CROSS REFERENCE TO RELATED APPLICATIONS

This application claims the benefit, under 35 U.S.C. § 119(e), of U.S. Provisional Patent Application Nos. 60/670,027, 60/670,040, and 60/670,041 all three of which were filed Apr. 11, 2005; and of U.S. Provisional Patent Application No. 60/720,598 which was filed Sep. 26, 2005. This application is also a continuation-in-part of U.S. application Ser. No. 11/229,759 which was filed Sep. 19, 2005 and which claimed the benefit, under 35 U.S.C. § 119(e), of U.S. Provisional Patent Application No. 60/626,627 which was filed Nov. 10, 2004. U.S. Provisional Application Nos. 60/670,027; 60/670,040; 60/670,041; 60/720,598 and U.S. application Ser. No. 11/229,759 are hereby expressly incorporated by reference herein.

BACKGROUND OF THE INVENTION

The present disclosure relates to accessories that attach to surgical tables to support portions of patients during surgery. More particularly, the present disclosure relates to accessory frames that attach to surgical tables and that are configured for supporting upper bodies of patients during surgery, such as, for example, spinal surgery.

Standard surgical tables, also referred to as operating tables or operating room (O.R.) tables, typically have pivotable patient support sections that are moved by actuators, such as electric linear actuators or hydraulic actuators, to place a patient in a desired position. The patient support sections of these standard tables usually have metal frames and the tables oftentimes further include other metal elements which interfere with the ability to obtain desired x-ray images or fluoroscopic images of a patient during surgery. During some surgeries, such as orthopedic surgery, and particularly, spinal surgery, it is fairly important for x-ray images and/or fluoroscopic images to be taken of a patient due to the implantation of screws, rods, replacement discs, and the like, in very close proximity to critical nerves including the spinal cord. As a result, standard surgical tables are not suitable for some surgeries.

Specialized orthopedic surgical tables have been developed for orthopedic surgery and a subset of these specialized orthopedic surgical tables, such as, for example, the "Jackson" table and the "Andrews" table, have been designed specifically for spinal surgery. Examples of the "Jackson" table may be found in U.S. Pat. Nos. 5,088,706; 5,131,106; 5,613,254; and 6,260,220. An example of the "Andrews" table may be found in U.S. Pat. No. 5,444,882. The various types of Jackson tables and the Andrews table are self-standing surgical tables which are very expensive, but which are only used for a small percentage of the surgeries that may be performed in a hospital.

Attempts have been made in the past to design substantially radiolucent table extensions that attach to standard surgical tables to support a patient during spinal surgery or other surgical procedures during which x-ray or fluoroscopic images are to be taken of the patient's upper body. See, for example, U.S. Pat. Nos. 4,995,067; 5,758,374; 6,003,174; 6,584,630; and 6,813,788. Each of the devices in the patents just listed include a table top or panel or similar such structure underlying the patient. In some surgical procedures in which a patient is in a prone position, such as some spinal surgery procedures, it is desirable for the patient's abdomen to hang downwardly without obstruction so as not to be supported by an underlying table surface. Accordingly, table extensions having such table tops or panels may not be suitable for some spinal surgery procedures. In addition, many of the known table extensions connect to the associated surgical table with a fixed connection that does not permit the extension to pivot relative to the surgical table in a manner that would permit flexure of a patient by a sufficient amount to place the lumbar region of the patient's spine in a more lordotic (i.e., more arched) or more kyphotic (i.e., flattened or hunched) position than when the patient is simply lying in a flat, prone position with the lumbar region of the patient's spine in its naturally arched position.

SUMMARY OF THE INVENTION

The present invention comprises an accessory or accessory system that is used with a surgical table, as well as a method of using such an accessory or accessory system, and that has one or more of the features listed in the appended claims, or one or more of following features or combinations thereof, which alone or in any combination may comprise patentable subject matter:

An accessory for attachment to a surgical table to support an upper body of a patient during surgery may comprise a pair of spaced radiolucent frame members to which patient support devices may be coupleable. The accessory may further have a coupler to freely pivotably couple the pair of spaced radiolucent frame members to the surgical table such that the pair of spaced radiolucent frame members extend away from the surgical table and are able to articulate relative to the surgical table in response to portions of the surgical table being moved. The pair of spaced radiolucent frame members may be configured and arranged such that the upper body of the patient may be supportable thereabove and at least a portion of the legs of the patient may be supportable by the surgical table during surgery. The spaced radiolucent frame members may be substantially parallel.

The pivotable coupling between the surgical table and the radiolucent frame members may allow an associated patient's spine to be made more lordotic or more kyphotic before, during, or after surgery by simply tilting or articulating the table section to which the radiolucent frame members are coupled. Such movement of the surgical table may be accomplished using one or more of the powered actuators of the surgical table, for example. The patient support devices which may be coupled to the pair of radiolucent frame members include head supports, chest supports, hip supports, and arm boards, just to name a few. In some uses of the accessory, there are no panels or table sections which extend between the radiolucent frame members beneath the patient's abdomen, thereby allowing the patient's abdomen to hang downwardly without obstruction. Panels or sections which may attach to the radiolucent section and which may support mattress pads, for example, are contemplated by this disclosure and may be attached at any desired position along the radiolucent frame members, including positions beneath a patient's abdomen.

The coupler between the radiolucent frame members and the surgical table may comprise at least one pivot shaft that extends generally horizontally from at least one of the frame members. The coupler may further comprise at least one clamp that is coupleable to the surgical table and that has a shaft support to support the shaft for pivoting movement about a generally horizontal axis. The clamp may comprise a block with a channel sized to receive an accessory rail of the surgical table. The shaft support may comprise a hook extending from the block and the hook may have a curved surface on which the at least one pivot shaft rests. During articulation of the radiolucent frame members relative to the surgical table, the shaft may rotatively slide on the curved surface of the hook.

The clamp may include a latch that is movable between a first position preventing the pivot shaft from being removed from the clamp and a second position allowing removal of the pivot shaft from the clamp. Additionally or alternatively, the clamp may have a boss that extends from the shaft support and the coupler may further comprise a collar mounted on the pivot shaft and having a recess. The collar may be movable along the shaft between a first position in which the boss is received in the recess to prevent the pivot shaft from being removed from the clamp and a second position in which the boss is situated outside the recess. The coupler may comprise a threaded screw coupled to the collar and movable to tighten against the pivot shaft to retain the collar in place on the pivot shaft. The accessory may have a retainer adjacent an end of the pivot shaft to prevent the collar from being removed from the pivot shaft.

The accessory may further comprise a connector block fastened to an end region of at least one of the frame members and the pivot shaft may be fastened to the connector block. The connector block may have a channel in which the end region of the at least one frame member is received and a bore in which a portion of the pivot shaft is received. The channel may extend in perpendicular relation to the bore. The accessory may also have a radiolucent cross frame member extending between the pair of spaced radiolucent frame members. The cross frame member may also be fastened to the connector block. The connector block may have another channel in which an end region of the cross frame member is received.

Each of the radiolucent frame members may comprise a carbon fiber tube and a filler material within the tube. The filler material may comprise a polyurethane foam material. Each of the radiolucent frame members may be generally quadrilateral in cross section. In some embodiments, the cross section of the radiolucent frame members may be about 1.25 inches (about 3.175 cm) in width and about 1.5 inches (about 3.81 cm) in height. In some embodiments, the radiolucent frame members of the accessory are spaced apart by about 14 inches (about 35.56 cm) as measured between the inside surfaces of the frame members (or, about 17.5 inches (about 44.45 cm) as measured between the outside surfaces of the frame members). In such embodiments having the frame members with this size and spacing, any device which would otherwise be attachable to a Jackson table, may be attached to the frame members of such embodiments.

Further according to this disclosure, an accessory that is attachable to a surgical table to support a patient during surgery and detachable from the surgical table for storage is provided. Such a storable accessory may comprise a frame having a pair of substantially parallel, elongated radiolucent frame members to which patient support devices may be coupleable. The frame may be configured such that the upper body of the patient is supportable thereabove during surgery. The accessory may further have a base and a support structure having a lower end region coupled to the base and extending upwardly therefrom. A first end of the frame may be coupled to an upper end region of the support structure. The frame may be pivotable relative to the support structure between a storage position in which a second end of the frame is supported on the base and a use position in which the second end of the frame is spaced from the base.

The base may include a base frame and a pair of hooks extending from the base frame. The frame may have a pair of pivot shafts extending outwardly relative to the elongated radiolucent frame members at the second end of the frame. The pair of pivot shafts may rest on the hooks when the frame is in the storage position. The base frame may be generally U-shaped and the hooks may extend from ends of the U-shaped base frame.

The accessory may further have a pair of rail clamps that are coupleable to the surgical table. The pair of pivot shafts may be coupleable to the rail clamps when the frame is in the use position. The frame may be coupled to the support structure by a first multi-axis joint and the support structure may be coupled to the base by a second multi-axis joint. The first and second multi-axis joints may permit the frame to pivot relative to the surgical table about an axis that extends laterally relative to the surgical table. In addition, the first and second multi-axis joints may permit the frame to pivot with the surgical table about an axis that extends longitudinally relative to the surgical table. The pivoting of the frame about these laterally extending and longitudinally extending axes may occur as a result of operation of the actuators of the surgical table to tilt front-to-rear and/or to tilt side-to-side the section of the surgical table to which the frame is coupled.

The support structure to which the frame is coupled may be extendable and retractable to change an elevation of the first end of the frame relative to the base. The support structure may comprise a telescopic leg and a jack screw that is operable to extend and retract the telescopic leg. The accessory may further comprise a set of wheels coupled to the base. The wheels may be spaced from a floor when the base is in a normal use position, and the wheels may engage the floor when the base, the support structure, and the frame are tipped for transport. A handle may be coupled to the support structure and the handle may be grippable to tip the base, the support structure, and the frame for transport. The handle may comprise a horizontal bar having gripping portions on opposite sides of the support structure.

Also according to this disclosure, an accessory may comprise a frame, a base which is supportable on a floor during surgery, a support structure extending upwardly from the base, a first multi-axis joint coupling a lower region of the support structure to the base, and a second multi-axis joint coupling an upper region of the support structure to the frame. The first multi-axis joint may be configured to permit pivoting movement of the support structure relative to the base about a first plurality of axes and the second multi-axis joint may be configured to permit pivoting movement of the frame relative to the support structure about a second plurality of axes.

The first multi-axis joint may comprise a ball joint. An amount of torque to pivot the ball joint may be adjustable. In some embodiments, the torque to pivot the ball joint may be adjustable by clamping an O-ring against a ball of the ball joint. The ball joint may comprise a foot pedal that is movable to adjust the torque required to pivot the ball joint. The ball joint may comprise a main housing having a generally spherical surface on which the ball is supported, a housing cap, an O-ring situated between the main housing and the housing cap and in contact with the ball, and an adjustable clamping assembly to clamp the O-ring between the housing cap and the main housing. The clamping assembly may comprise a set of flexible washers situated on the housing cap, a cam coupled to the main housing, a follower coupled to the cam, and a member extending through bores of the set of flexible washers and coupled to the follower such that movement of the cam may result in movement of the follower which acts through the member to adjust an amount by which the set of flexible washers are squeezed thereby to adjust an amount of force with which the O-ring is forced against the ball by the housing cap.

The support structure which interconnects the base and frame may be elongated and define an axis. The ball joint may be restricted from pivoting about an axis that is substantially coincident with and/or parallel to the axis defined by the support structure. For example, the ball joint may comprise a ball, a main housing having a generally spherical surface on which the ball is supported, the main housing having at least one groove that is recessed relative to the generally spherical surface, and a shaft that extends through a bore formed in the ball, the shaft having opposite ends that project beyond the ball and that are received in the groove to restrict the pivoting of the ball about the axis that is substantially coincident with and/or parallel to the axis defined by the support structure. The ball may have an opening that intersects the bore and the support structure may have a lower segment that is received by the opening. The shaft extending through the bore of the ball may also couple the lower segment of the support structure to the ball.

The second multi-axis joint comprises a universal joint. The support structure may comprise a telescopic arm and a cantilevered member extending from an upper region of the telescopic arm. The universal joint may be coupled to the cantilevered member so as to be offset from the telescopic arm. The support structure may comprise a hand crank that is coupled to the cantilevered member and that is rotated in first and second directions to extend and retract, respectively, the telescopic arm. The universal joint may comprise a first yoke fixed to the cantilevered member, a second yoke coupled to the first yoke for pivoting movement about a pair of perpendicular axes, and a plate fixed to the second yoke.

The frame may comprise a cross member that spans between the pair of radiolucent frame members and that is coupled to the plate. The cross member coupled to the plate may be substantially straight or may be curved such that, during use of the accessory, a central region of the cross member which is coupled to the plate is situated at a higher elevation than end regions of the cross member to which the radiolucent frame members couple. Pulleys may be provided on the cross member for use with cervical traction equipment. A flexible cover may be provided to shield the universal joint. The flexible cover may have a first end secured to the cantilevered member and a second end secured to the plate. An angle indicator may be mounted to the cantilevered member. The angle indicator may provide a visual indication of the angle of inclination of the frame relative to horizontal.

A panel that may couple to the frame members of the frame of the accessory is also provided. Ends of the panel may be supported on respective ones of the pair of spaced frame members and such that the panel spans across a space defined between the frame members. At least one of the ends of the panel may have a notch through which at least a portion of one of the frame members is exposed. A first clamp may couple to the portion of one of the frame members exposed in the notch. The first clamp may have an accessory rail and a second clamp may couple to the accessory rail. A mattress pad may couple to the panel. The mattress pad may have a portion that overlies the notch and the first clamp when the mattress pad is coupled to the panel. A limb support, such as an arm support, may couple to the second clamp.

In one disclosed embodiment, the floor-supported base and the support structure are omitted and a strut extending to another portion of the surgical table is provided to support the frame relative to the surgical table. The strut may extend from the frame. Such an embodiment may be used, for example, with a surgical table having a first patient support section movable to a generally horizontal position and a second patient support section movable to a generally vertical position extending downwardly with respect to the first patient support section. A first coupler may couple the frame to the first patient support section of the surgical table for pivoting movement about an axis. A second coupler may couple the strut to the second patient support section of the surgical table such that powered articulation of the second patient support section relative to the first patient support section results in pivoting movement of the frame relative to the first patient support section.

The support strut may comprise a pair of radiolucent support struts. Each radiolucent support strut may extend beneath a respective one of the radiolucent frame members of the frame. As may be the case with frame members of the frame, the radiolucent struts may each comprise a carbon fiber tube and a filler material in an interior region of the carbon fiber tube. The filler material of the struts may comprise a polyurethane foam material.

A method of using the accessories and/or accessory systems disclosed herein may comprise attaching rails clamps to rails of a surgical table, moving a frame from a storage position to a use position having one end of the frame coupled to the clamps, and adjusting a height of a second end of the frame such that the frame freely pivots relative to the rail clamps. The method may further comprise tilting a section of the surgical table to which the frame is coupled by the rail clamps. The section of the surgical table may be tilted about an axis extending lengthwise of the surgical table or widthwise of the surgical table. Coupling the frame to the rail clamps may comprise inserting pivot shafts of the frame into hook portions of the rail clamps. Adjusting the height of the second end of the frame may comprise operating a jack screw of a support structure that supports one of the ends of the frame relative to a floor-supported base.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which:

FIG. 18 is a sectional view, taken along line 18-18, of FIG. 16 showing the connection between one of the side frame members of the frame and an associated corner connector block;

FIG. 19 is a sectional view through the rail clamp showing a latch of the rail clamp in a locking position to prevent removal of a pivot shaft of the frame from a hook of the rail clamp and showing a threaded screw extending through a collar and tightened against a flat portion of the pivot shaft;

FIG. 20 is a sectional view through the collar and rail clamp showing the collar positioned on a first side of the rail clamp and moved to a position adjacent to the rail clamp so that a first boss projecting from a first side of the rail clamp is received in a first annular recess of the collar;

FIG. 21 is a sectional view, similar to FIG. 20, showing the collar positioned on a second side of the rail clamp and moved to a position adjacent to the rail clamp so that a second boss projecting from a second side of the rail clamp is received in a second annular recess of the collar;

DETAILED DESCRIPTION OF THE DRAWINGS

Figure 1:
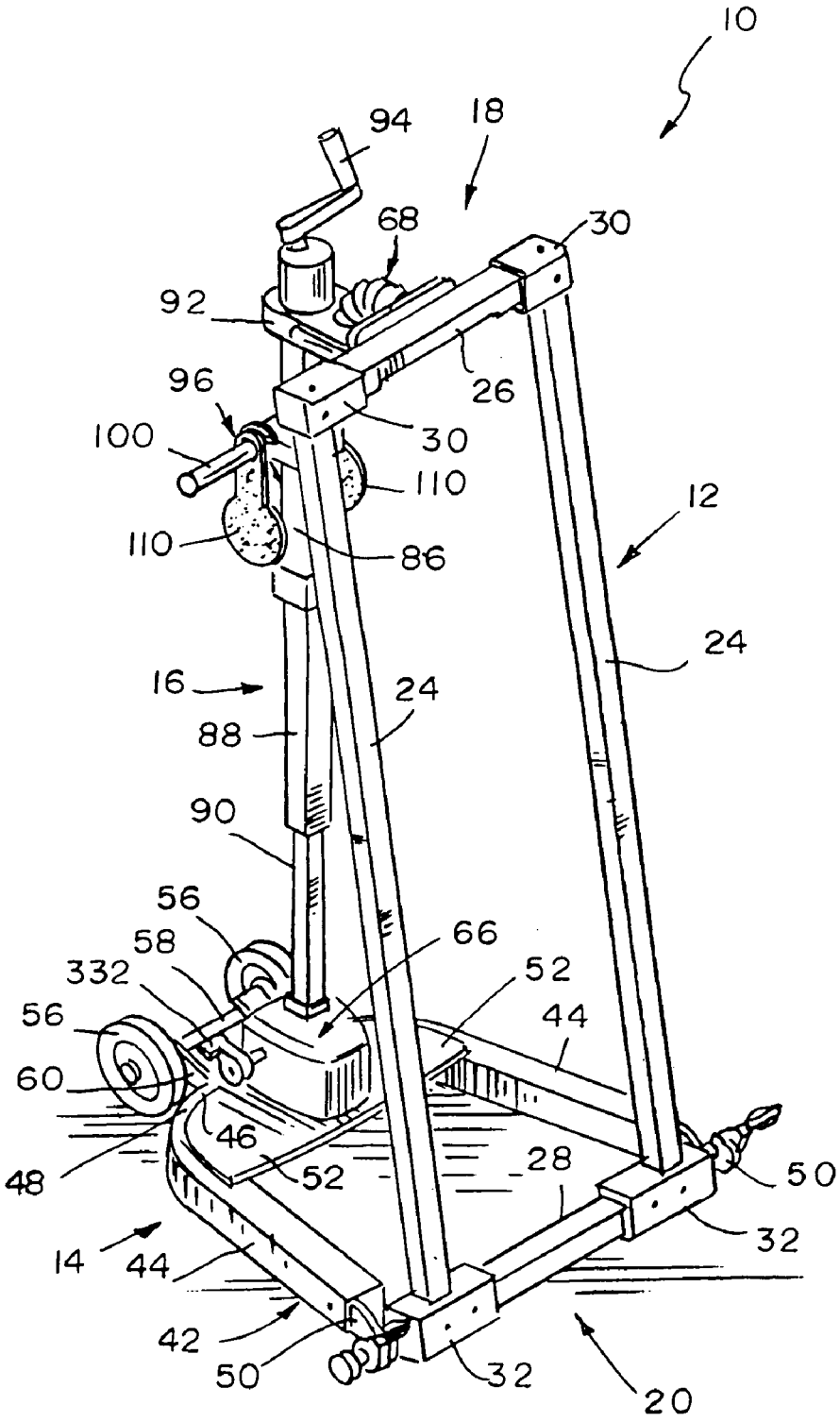
FIG. 1 is a front perspective view of a surgical accessory in a storage position, the accessory having a base, a telescopic support structure extending upwardly from the base, and a generally rectangular frame having a first end coupled to an upper region of the telescopic support structure and having a lower end resting upon a front portion of the base.
Figure 2:
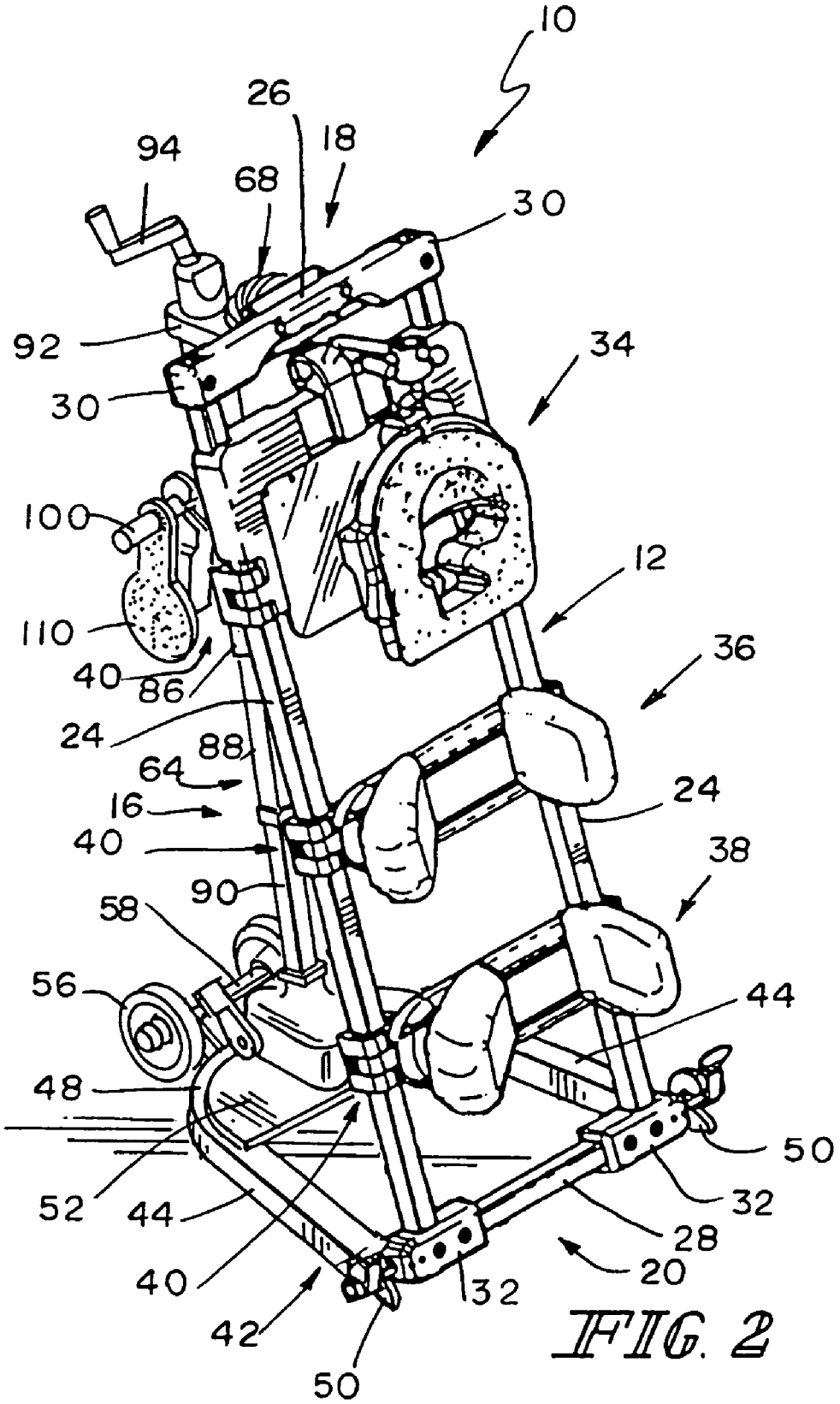
FIG. 2 is a front perspective of the surgical accessory of FIG. 1, still in the storage position, but having a head support device, a chest support device, and a hip support device coupled to elongated side frame members of the frame.

An accessory 10 according to this disclosure has a substantially radiolucent frame 12, a floor-supported base 14, and a support structure 16 that extends upwardly from base 14 and that couples to a first end 18 of frame 12 as shown in FIG. 1.

Figure 8:
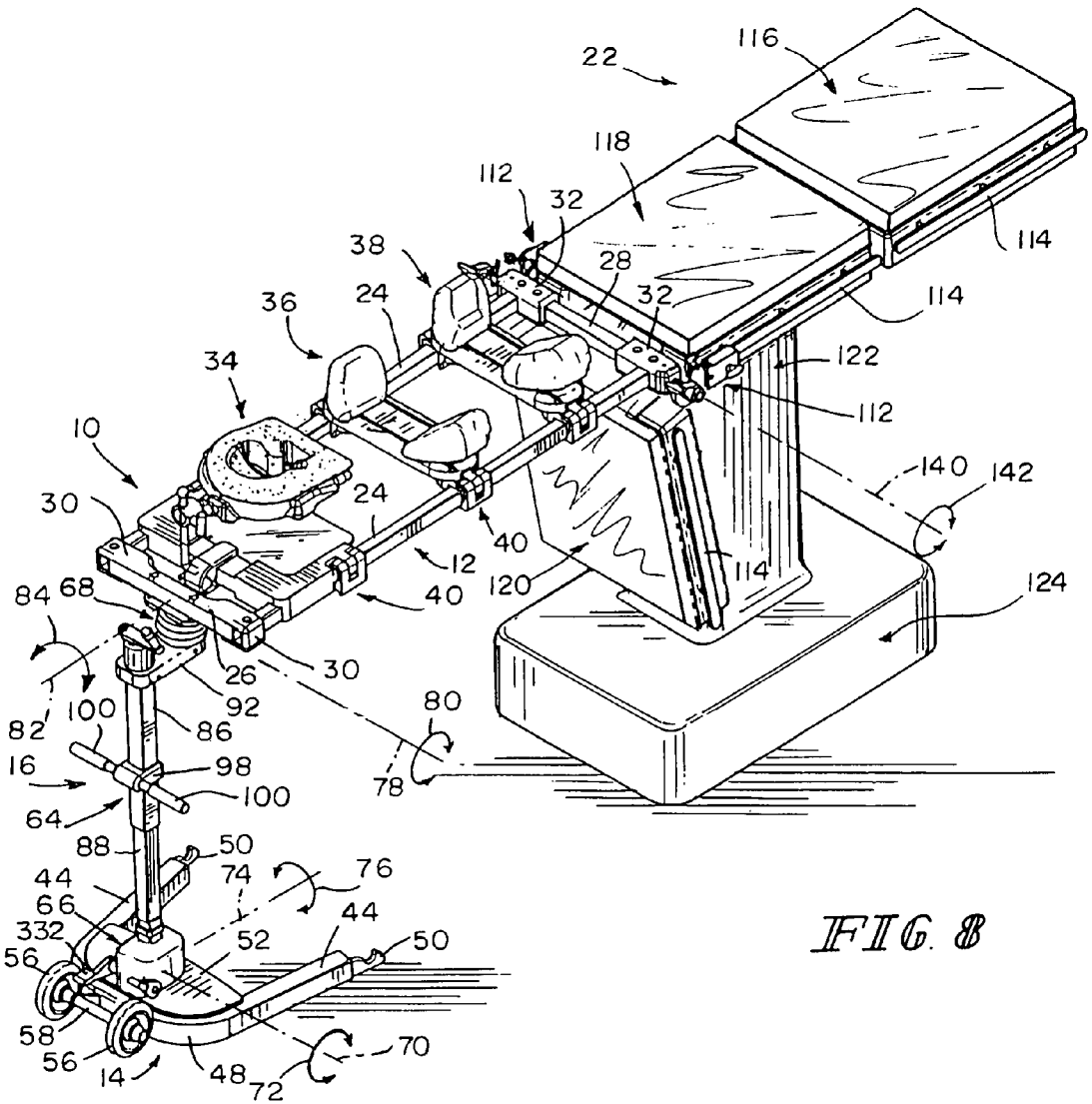
FIG. 8 is a perspective view showing the second end of the frame coupled to the rail clamps and the telescopic support structure supporting the first end of the frame at an elevation in which the frame is in a generally horizontal position.
Figure 9:
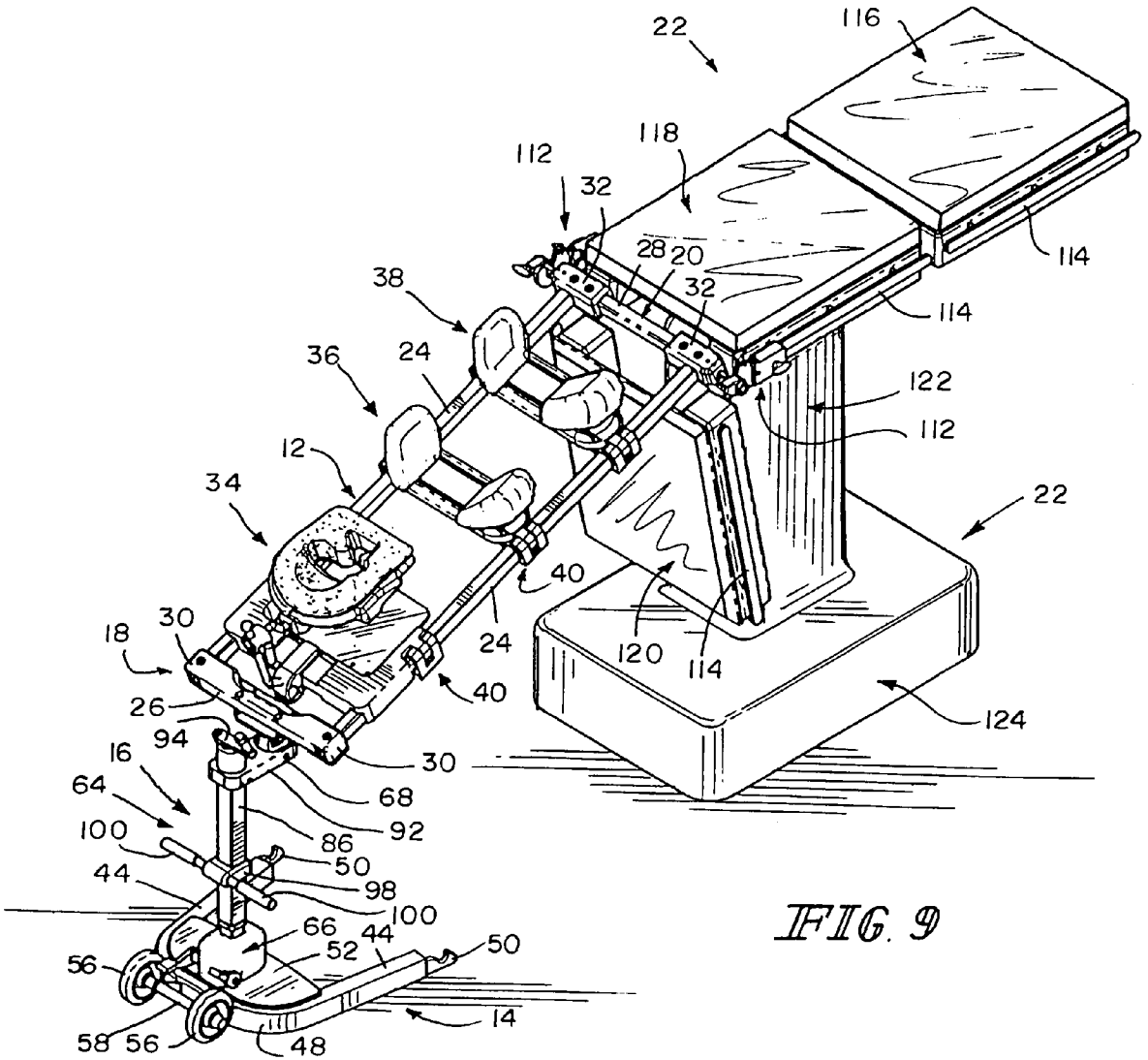
FIG. 9 is a perspective view, similar to FIG. 8, showing the telescopic support structure in a retracted position having the first end of the frame supported at an elevation lower than the second end of the frame.

Accessory 10 is movable between a compact storage position, shown in FIGS. 1-6, and a use position shown, for example, in FIG. 8. In the storage position, a second end 20 of frame 12 is supported on a portion of base 14 and, in the use position, second end 20 of frame 12 is coupled to a surgical table 22 with which accessory 10 is used during surgical procedures.

Frame 12 includes a pair of spaced radiolucent side frame members 24, a first cross member 26 at first end 18 of frame 12, and a second cross member 28 at second end 20 of frame 12 as shown in FIG. 1. Thus, in the illustrative embodiment, frame 12 pivots upwardly and downwardly as a unit relative to support structure 16. In other embodiments, cross member 28 may be omitted and each of side frame members 24 may be independently pivotable between storage and use positions. In such embodiments having cross member 28 omitted, frame members 24 may be pivotably coupled to cross member 26, for example.

A pair of first corner connectors 30 are formed integrally with cross member 26 and are configured to couple to one end of respective frame members 24. A pair of second corner connectors 32 are configured to couple to opposite ends of respective frame members 24 and to ends of cross member 28. Thus, frame 12 is substantially rectangular in its overall shape having frame members 24 oriented in parallel relation to each other.

Various patient support devices are coupleable to frame 12. For example, a head support device 34, a chest support device 36, and a hip support device 38 are coupleable to frame 12 as shown, for example, in FIGS. 2-5. Illustrative devices 34, 36, 38 have clamps 40 which are sized and configured to attach to frame members 24 of frame 12. As shown in FIGS. 2-5, devices 34, 36, 38 may be stored along with accessory 10 when accessory 10 is in the storage position. Additional details of head support device 34, as well as other head support devices, which may be coupled to frame 12 are provided in U.S. application Ser. No. 11/402,332, which it titled "Head Support Apparatus for Spinal Surgery," which is filed concurrently herewith, and which is hereby expressly incorporated by reference herein. Additional details of chest support device 36 and hip support device 38, as well as other body support devices, which may be coupled to frame 12, are provided in U.S. application Ser. No. 11/402,327), which it titled "Body Support Apparatus for Spinal Surgery," which is filed concurrently herewith, and which is hereby expressly incorporated by reference herein. Additional details of clamp 40, which is included in each of devices 34, 36, 38 and which may be included in other devices which are attachable to frame members 24 of frame 12, are provided in U.S. application Ser. No. 11/402,331, which is titled "Accessory Rail Clamp with Latch and Lock Mechanisms," which is filed concurrently herewith, and which is hereby incorporated by reference herein.

Base 14 includes a U-shaped base frame member 42 having a pair of side portions 44 and a rear portion 46. Frame member 42 is made of a metal tube that has a generally square cross section and that is bent to form rounded corner regions 48 at the junction between portions 44 and portion 46. Frame members 42 are not parallel in the illustrative example, but rather, angle slightly outwardly from the rear to the front of base 14 as shown, for example, in FIGS. 1-3. Base 14 further includes a pair of hooks 50, each of which extends from an open front end of the respective portion 44 of frame member 42, and a generally horizontal support plate 52 that is fastened to the top of frame member 42. A rear portion of plate 52 overlies portion 48 of frame member 42 and side portions of plate 52 overlie respective portions 44 of frame member 42 such that plate 52 spans from one side portion 44 to the other.

Figure 5:
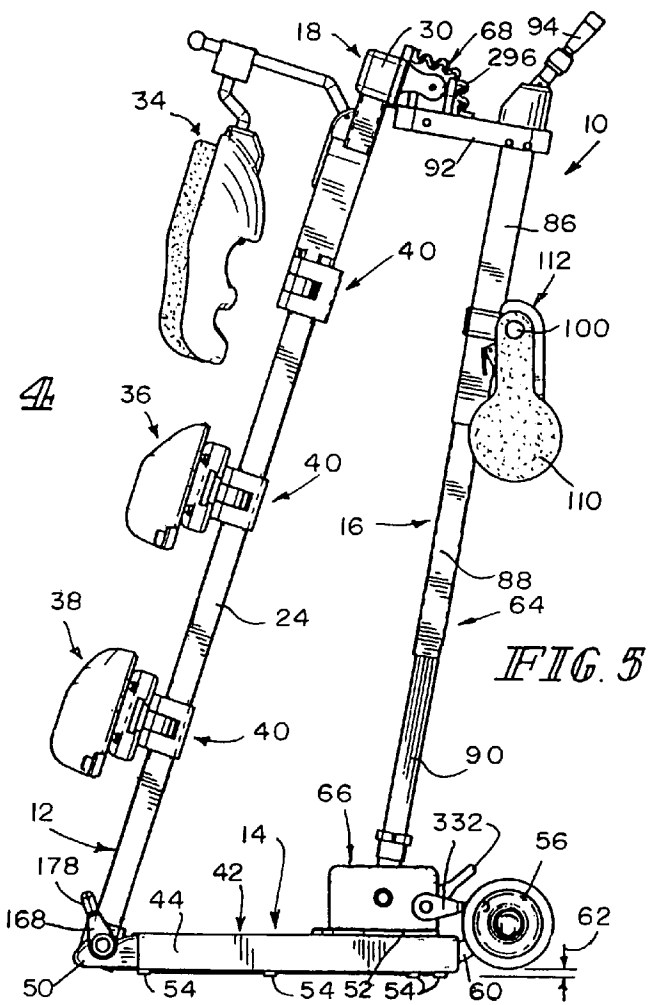
FIG. 5 is a side elevation view of the accessory in the storage position with the head, chest, and hip support devices coupled to the frame showing the frame and telescopic support structure being in an inclined, non-vertical orientation when the accessory is in the storage position.
Figure 4:
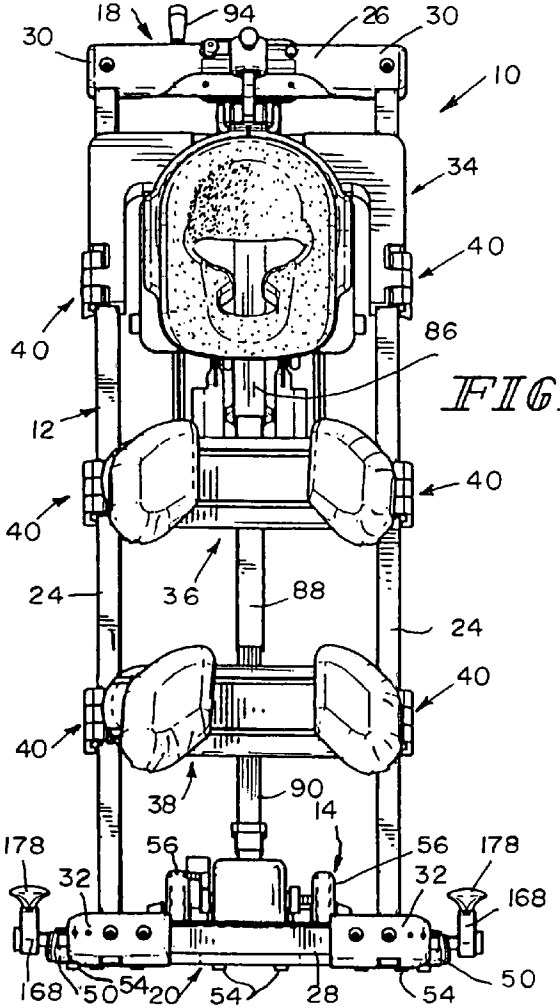
FIG. 4 is a front elevation view of the accessory in the storage position with the head, chest, and hip support devices coupled to the frame.

Base 14 also has a set of resilient floor-engaging feet or pads 54 that are secured to the bottom of frame member 42 as shown in FIGS. 4 and 5. Pads 54 are made of a material, such as rubber or urethane, which has a tendency to resist slipping on hard smooth floor surfaces, such as tile floor surfaces or smooth concrete floor surfaces, of the type that are typically found in operating rooms. Base 14 further includes a pair of wheels 56 having an axle 58 extending therebetween. A pair of axle support links 60, shown in FIGS. 1, 2, and 5, angle upwardly from rear portion 46 and support axle 58 and wheels 56 relative to frame member 42. When accessory 10 is in the storage position or use position having pads 54 contacting an underlying floor surface, the bottom of both wheels 56 are spaced from the floor by a slight distance 62 as shown in FIG. 5. To transport accessory 10 from one location to another in a healthcare facility, accessory 10 is tipped rearwardly such that wheels 56 contact the underlying floor and pads 54 are lifted up off of the floor. Accessory 10 is then wheeled to its new location with wheels 56 rolling upon the floor.

Support structure 16 includes a telescopic leg 64, a first multi-axis joint 66 coupling a lower end of telescopic leg 64 to plate 52 of base 14 and a second multi-axis joint 68 coupling an upper end of telescopic leg 64 to cross member 26 of frame 12 as shown, for example, in FIGS. 1-3 and 5. As shown in FIG. 8, first multi-axis joint 66 is configured to permit pivoting movement of telescopic leg 64 of support structure 16 relative to the base 14 about a first plurality of axes, including permitting front-to-rear tilting of leg 64 about a lower lateral axis 70 as indicated by double-headed arrow 72 and permitting side-to-side tilting of leg 64 about a lower longitudinal axis 74 as indicated by double-headed arrow 76. As also shown in FIG. 8, second multi-axis joint 68 is configured to permit pivoting movement of frame 12 relative to telescopic leg 64 of support structure 16 about a second plurality of axes, including permitting front-to-rear tilting of frame 12 about an upper lateral axis 78 as indicated by double-headed arrow 80 and permitting side-to-side tilting of frame 12 about an upper longitudinal axis 82 as indicated by double-headed arrow 84.

In the illustrative embodiment, joint 66 comprises a ball joint (referred to herein sometimes as "ball joint 66") and joint 68 comprises a universal joint (referred to herein sometimes as "universal joint 68"). However, both joints 66, 68 may be ball joints or both joints 66, 68 may be universal joints in other embodiments. Any joint permitting pivoting about multiple pivot axes are intended to be within the scope of this disclosure and may be used as multi-axis joints 66, 68 in lieu of the illustrative ball joint 66 and universal joint 68.

Figure 3:
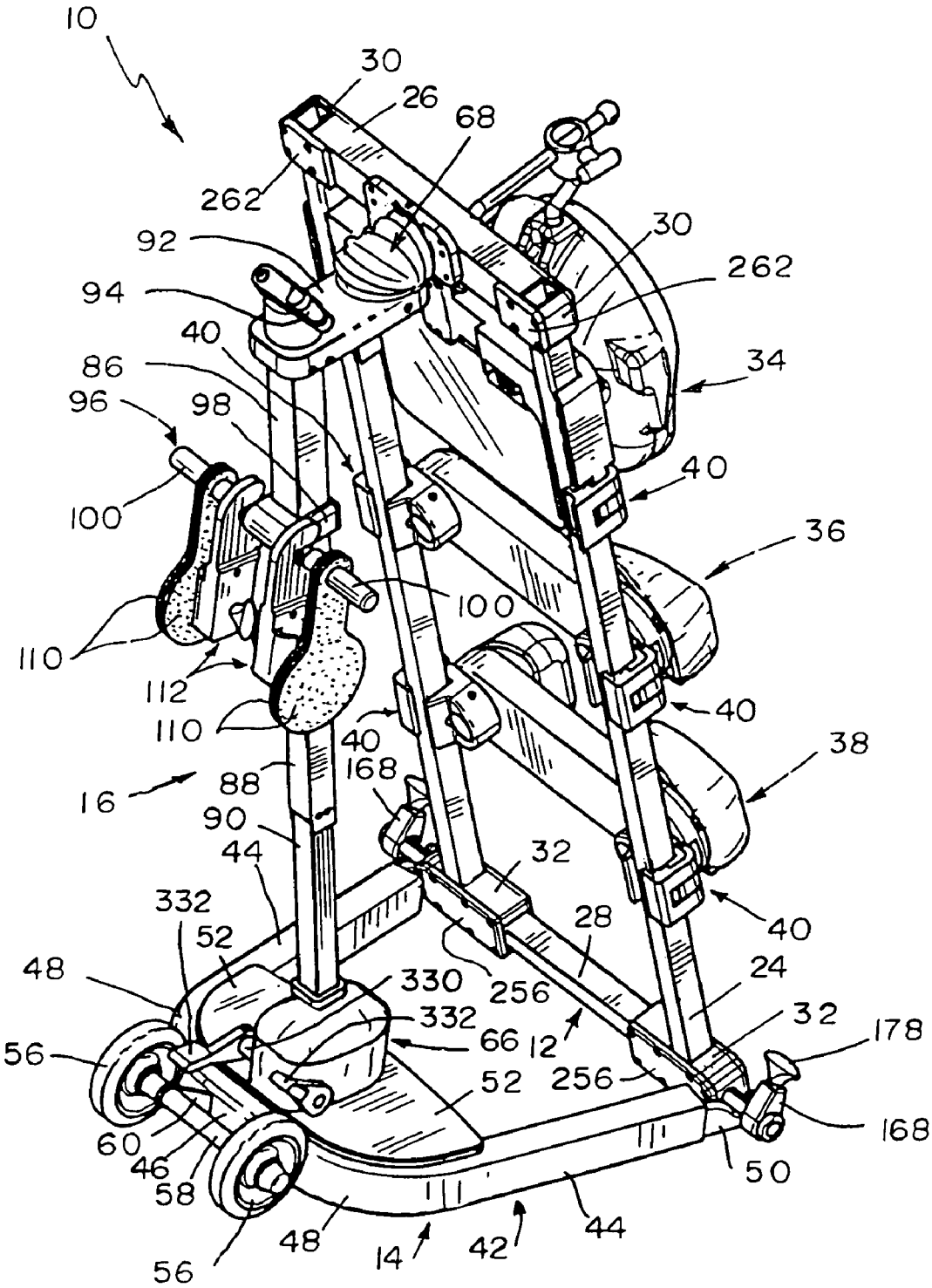
FIG. 3 is a rear perspective of the surgical accessory of FIG. 2 with the head, chest, and hip support devices coupled thereto, showing a pair of wheels coupled to the base frame and showing a generally horizontal grip handle coupled to an upper tube of the telescopic support structure.

Telescopic leg 64 includes an upper tube 86, a middle tube 88, and a lower tube 90, as shown, for example, in FIGS. 1, 3 and 5. A lower end of lower tube 90 couples to ball joint 66 and an upper end of upper tube 86 couples to one end of a plate 92 of support structure 16. Plate 94 extends from tube 86 of leg 64 in a cantilevered manner and universal joint 68 is coupled to plate 94 and extends upwardly therefrom. Universal joint 68, therefore, is offset from telescopic leg 64. Support structure 16 further has a crank handle 94 which is rotated in a first direction to extend telescopic leg 64 to raise the elevation of first end 18 of frame 12 relative to base 14 and which is rotated in a second direction, opposite to the first direction, to retract telescopic leg 64 to lower the elevation of first end 18 of frame 12 relative to base 14. Support structure 16 also includes a generally horizontal grip handle 96 that is fastened to a collar 98 which, in turn, is fastened to a middle region of upper tube 86. Handle 96 comprises a cylindrical bar having gripping portions 100 situated on opposite sides of upper tube 86 telescopic leg 64.

Figure 6:
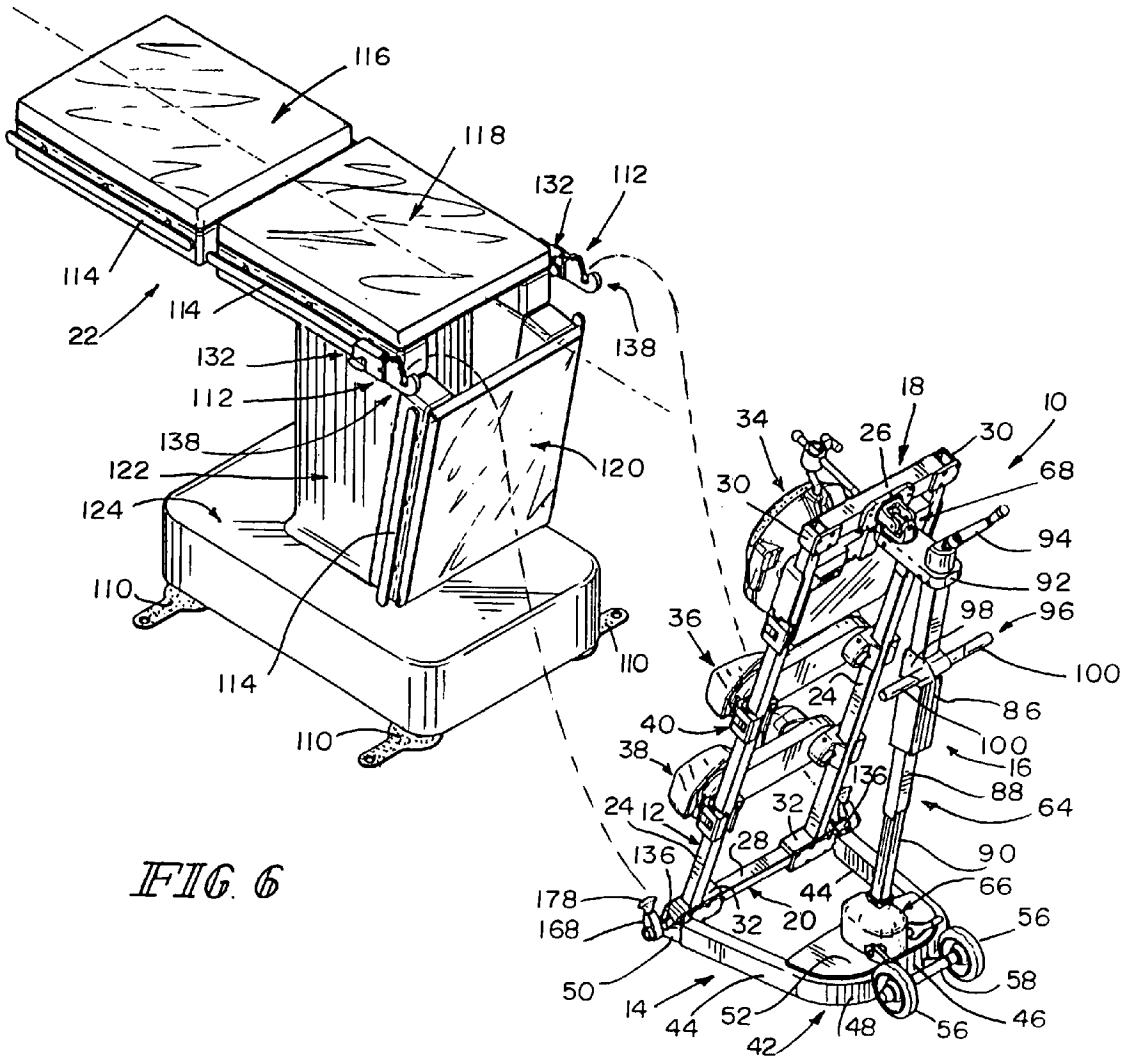
FIG. 6 is a perspective view of the accessory located near a surgical table showing rail clamps of the accessory attached to accessory rails of the surgical table at positions suitable for coupling to portions of the second end of the frame as indicated by the dotted lines.

Accessory 10 includes a set of anti-skid pads 110 and a pair of rail clamps 112 which may be hung on gripping portions 100 of handle 96, if desired, when accessory 10 is in the storage position as shown best in FIG. 3. Prior to coupling frame 12 to surgical table 22, the anti-skid pads 110 may be placed beneath the support feet (not shown) of the surgical table 22 and rail clamps 112 are coupled to accessory rails 114 as shown in FIG. 6. The support feet of surgical table 22 are sometimes referred to in the art as "floor locks." Pads 110 are made of a resilient material, such as rubber or urethane, and are lollipop-shaped in the illustrative embodiment, each having a large circular disk-like portion which is placed under an associated support foot of surgical table 22 and having a narrow stem portion with a hole through which gripping portions 100 of handle 96 extend when pads 110 are hung on handle 96. In the illustrative example, pads 110 are flexible, have generally planar top and bottom surfaces, and have uniform thickness between the top and bottom surfaces at all locations. Placing pads 110 beneath the support feet of surgical table 22 helps prevent table 22 from slipping on the underlying floor of the operating room.

In the illustrative example of FIGS. 6-10, surgical table 22 is a three-section table having a head section 116, a seat section 118, and a foot section 120 supported by a pedestal 122 above a base 124. Prior to coupling accessory 10 to surgical table 22, foot section 120 is pivoted downwardly to a generally vertical position and rail clamps 112 are attached to accessory rails 114 of seat section 118. However, if desired, rail clamps 112 may be coupled to the accessory rails 114 of head section 116 or foot section 120 assuming, in that case, foot section 120 is raised to a generally horizontal position. In the illustrative example of FIGS. 11-14, surgical table 22 is a five-section table having a torso section 126, a seat section 128, and a thigh section 130 supported by pedestal 122 above base 124. A foot section (not shown) and a head section (not shown) have been removed from the table 22 of FIGS. 11-14. Frame 12 of accessory 10 is coupled to the thigh section 130 in the example of FIGS. 11-14. Thus, regardless of the design of the surgical table with which accessory 10 is to be used, frame 12 of accessory is able to be coupled to the surgical table as long as the table has accessory rails 114 to which rail clamps 112 may be coupled at appropriate locations.

Figures 16, 17:
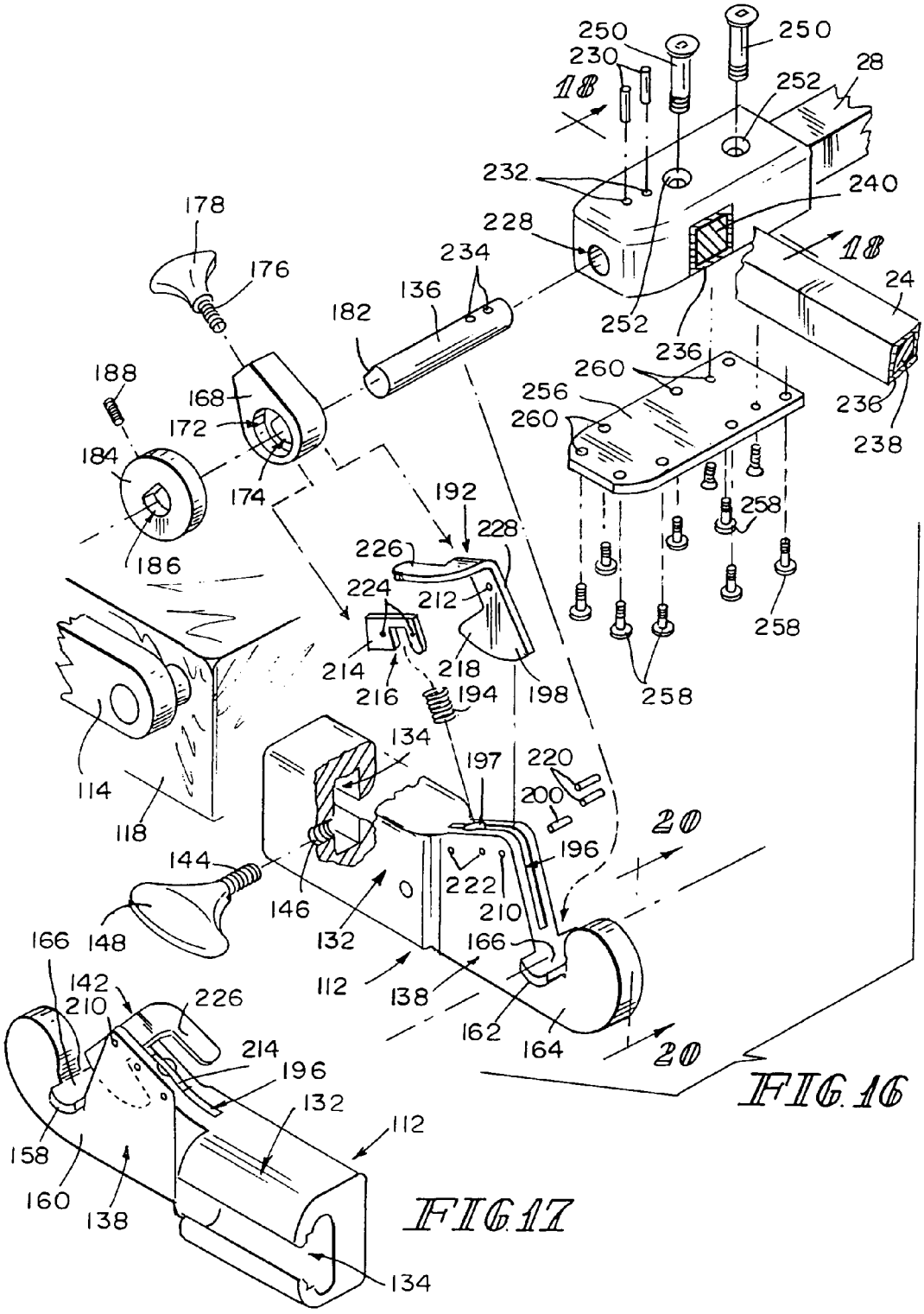
FIG. 16 is an exploded perspective view showing the components of the rail clamp and components at one of the corners of the frame which couples to the rail clamp.
FIG. 17 is a perspective view of one of the rail clamps in an assembled state.

Frame 12 includes a pair of pivot shafts 136, one of which is shown best in FIG. 16, which extend laterally outwardly from respective corner connectors 32 of frame 12. Thus, accessory 10 has two shafts 136 that extend outwardly in opposite directions from corner connectors 32. Shafts 136 cooperate with rail clamps 112 to provide accessory 10 with couplers that freely pivotably couple frame 12 to surgical table 22 for pivoting movement about a laterally extending axis 140 as indicated by double-headed arrow 142 in FIG. 8. Rail clamps 112 comprise a block 132 provided with a channel 134 that is sized to receive any of accessory rails 114 therein with a minimal amount of clearance between the rail 114 and block 132. Rail clamps 112 each further comprise a hook 138 extending generally horizontally from the respective block 132 when clamps 112 are coupled to rails 114. Each clamp 112 also has a screw 144, shown in FIG. 16, which threads through a threaded aperture 146 in block 132 and a knob 148 which is turned in one direction to tighten an end of screw 146 against the associated rail 114 to lock clamp 112 in place on the rail 114 and which is turned in an opposite direction to loosen screw 146 from the rail 114 to permit removal of clamp 112 from the rail 114.

Figure 7:
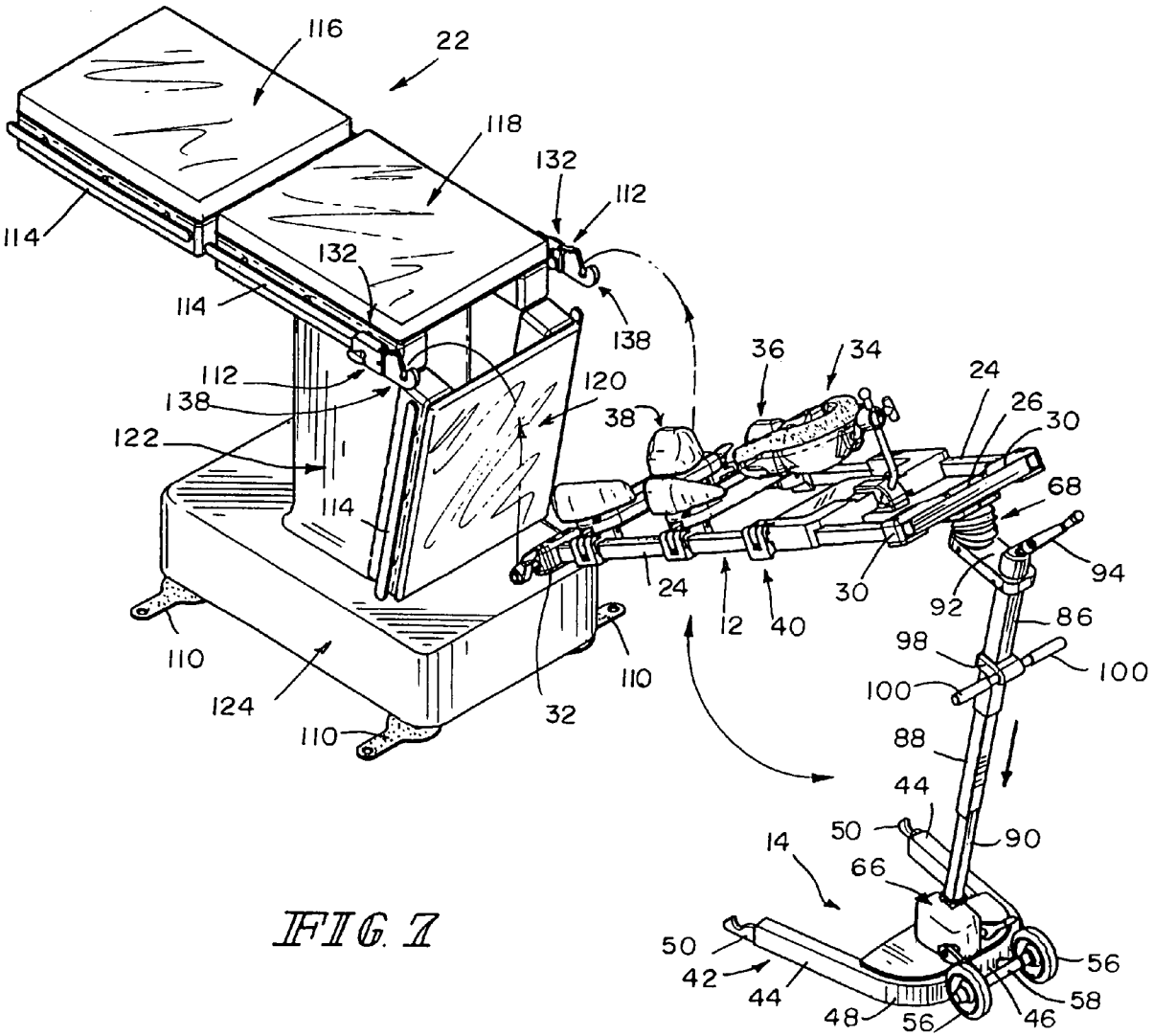
FIG. 7 is a perspective view, similar to FIG. 6, showing the frame being pivoted such that the second end of the frame moves away from the base and toward the rail clamps that are attached to the surgical table.

When frame 12 of accessory 10 is in the storage position, as shown in FIGS. 1-6, shafts 136 are received by, and rest upon, hooks 50 of base 14. After accessory 10 is transported while in the storage position to a location spaced from table 22 by an amount approximately equal to the length of frame 12 as shown in FIG. 6, shafts 136 are unhooked from hooks 50 and frame 12 is pivoted upwardly relative to support structure 16 as shown in FIG. 7, and then shafts 136 are placed upon hooks 138 of rail clamps 112 to couple frame 12 to surgical table 22 as shown in FIG. 8. In the illustrative embodiment, frame 12 is about 48.5 inches (1.2 m) in length as measured between the inside surfaces of frame members 26, 28.

After frame 12 is coupled to table 22, hand crank 94 may be rotated to extend and retract telescopic leg 64 as desired to change the elevation of first end 18 of frame 12 relative to base 14 and the powered actuators, such as hydraulic cylinders or linear actuators, of table 22 may be operated as desired via user inputs of control devices (not shown), such as a hand pendant, of table 22 to raise and lower pedestal 122, to tilt the patient support sections (e.g., section 116, 118 of table 22 of FIGS. 6-10 or sections 126, 128, 130 of table 22 of FIGS. 11-14) front to rear about respective lateral axes, and to the patient support sections side to side about a longitudinal axis.

Figure 10:
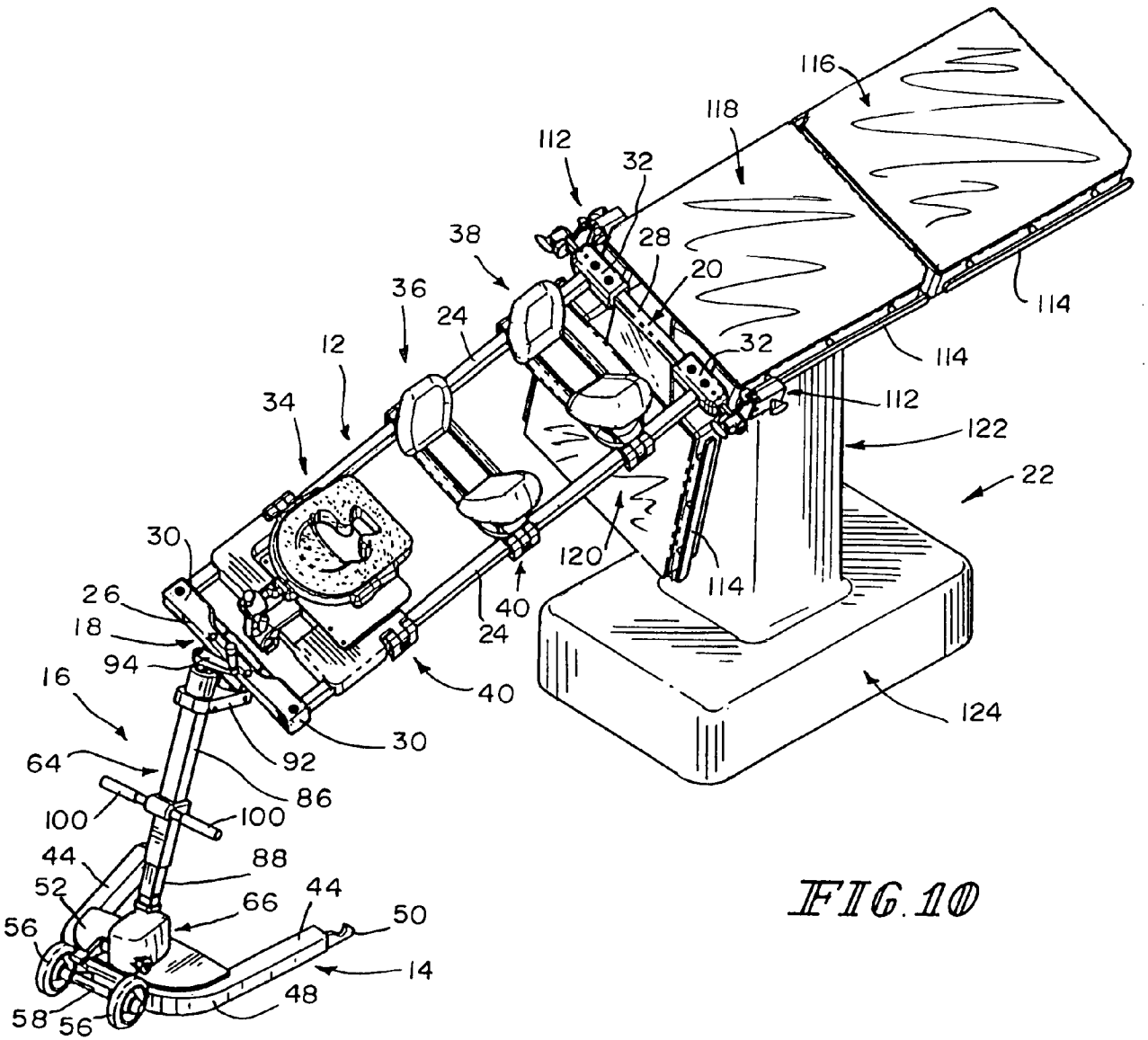
FIG. 10 is a perspective view, similar to FIG. 9, showing the patient support sections being tilted to one side and the frame and support structure of the accessory also tilting to one side.
Figure 11:
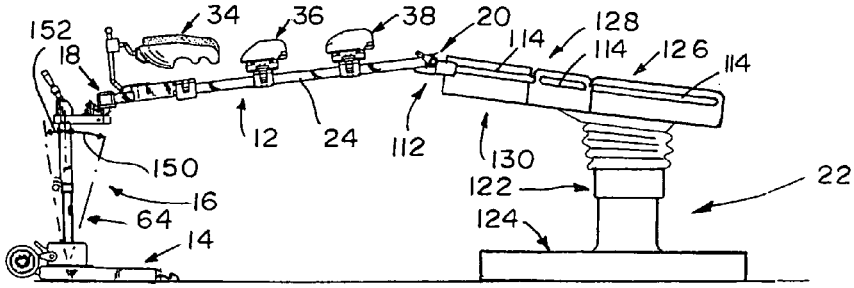
FIG. 11 is a side elevation view showing the accessory and surgical table in an upwardly flexed position having the coupling between the accessory and the surgical table raised upwardly relative to the opposite ends of the accessory and surgical table.

Based on the foregoing, it will be appreciated that accessory 10 and table 22 may be placed in a variety of positions to support a patient in any number of positions at the option of the surgeon. For example, in FIG. 8, frame 12 of accessory 10 and sections 116, 118 are in horizontal positions and in FIG. 9, telescopic leg 64 has been retracted to its lowest position to lower head end 18 of frame 12 to a lower elevation than foot end 20 of frame 12. In FIG. 10, the telescopic leg 64 has been retracted so that the head end 18 of frame is slightly lower in elevation than foot end 20 of frame 12 and sections 116, 118, 120 have been rotated to one side about a longitudinal axis of table 22. In FIG. 11, sections 126, 128, 130 of table 22 have been tilted upwardly such that foot end 20 of frame 12 is higher in elevation than head end 18 of frame 12 to place accessory 10 and table 22 in an upwardly flexed position. Osteotomy, discectomy, and laminectomy are examples of the types of surgical procedures that may be performed when accessory 10 and table 22 are in the upwardly flexed position and the patient is supported in a prone position on accessory 10 and table 22. The upwardly flexed position of accessory 10 and table 22 increases the kyphosis of the patient's spine.

Figure 12:
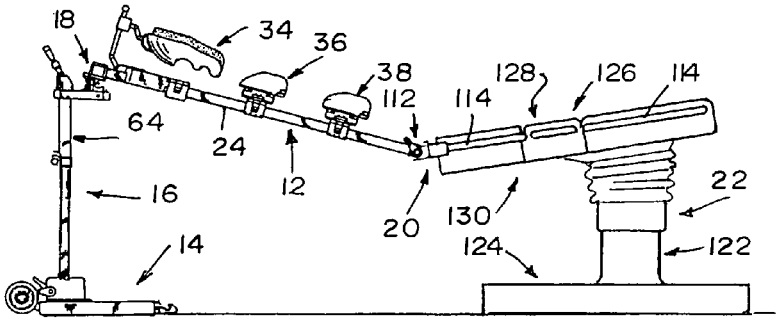
FIG. 12 is a side elevation showing the accessory and surgical table in a downwardly flexed position having the coupling between the accessory and surgical table lowered downwardly relative to the opposite ends of the accessory and surgical table.
Figure 13:
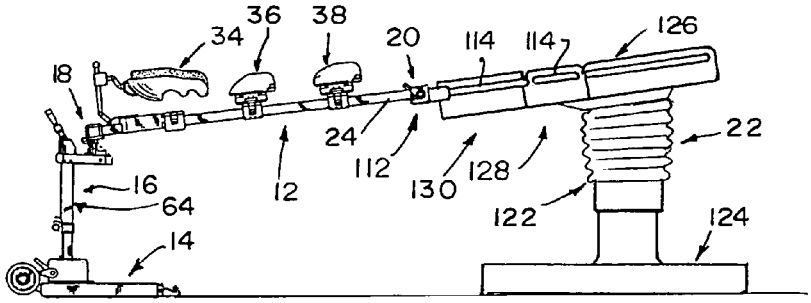
FIG. 13 is a side elevation view showing the accessory and surgical table in a Trendelenburg position having the frame of the accessory aligned with the patient support sections of the surgical table and having the first end of the frame supported at a lower elevation than the opposite end of the surgical table.
Figure 14:
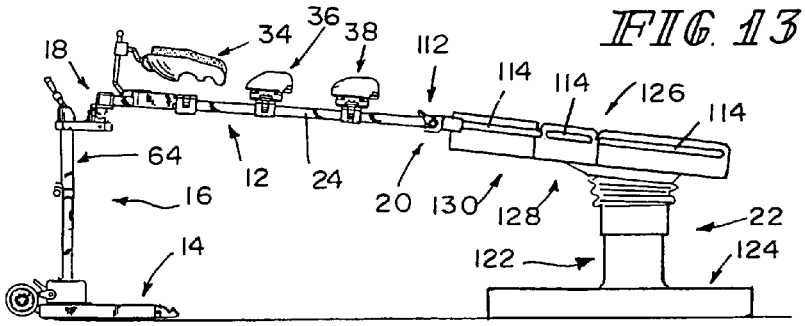
FIG. 14 is a side elevation view showing the accessory and surgical table in a reverse Trendelenburg position having the frame of the accessory aligned with the patient support section of the surgical table and having the first end of the frame supported at a higher elevation than the opposite end of the surgical table.

In FIG. 12, sections 126, 128, 130 of table 22 have been tilted downwardly such that foot end 20 of frame 12 is lower in elevation than head end 18 of frame 12 to place accessory 10 and table 22 in a downwardly flexed position. Fusion and spondylolisthesis are examples of the types of surgical procedures that may be performed when accessory 10 and table 22 are in the downwardly flexed position and the patient is supported in a prone position on accessory 10 and table 22. The downwardly flexed position of accessory 10 and table 22 increases the lordosis of the patient's spine. In FIG. 13, sections 126, 128, 130 of table 22 have been tilted downwardly and the head end 18 of frame 12 has been lowered such that frame 12 maintains its alignment with sections 126, 128, 130 to place accessory 10 and table 22 in a Trendelenburg position. In FIG. 14, sections 126, 128, 130 of table 22 have been tilted upwardly and the head end 18 of frame 12 has been raised such that frame 12 maintains its alignment with sections 126, 128, 130 to place accessory 10 and table 22 in a reverse Trendelenburg position.

Figure 28:
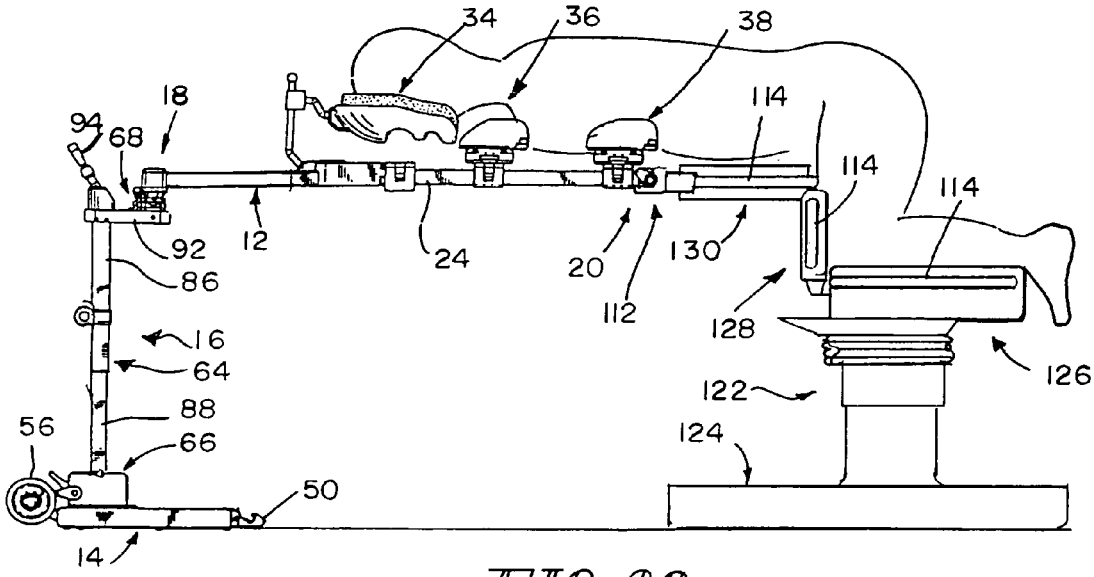
FIG. 28 is a side elevation view showing the accessory and surgical table moved to positions in which a patient is supported in a manner similar to that in which an Andrews table supports a patient.

In FIG. 28, section 128 of table 22 is moved into a generally vertical orientation extending upwardly from section 126 and section 130 is in a generally horizontal orientation extending from an upper end of section 128. Frame 12 extends generally horizontally from section 130. When accessory 10 and surgical table 22 are in the FIG. 28 orientation, a patient may be supported thereon in a kneeling, face-down position, much the same way that an Andrews table supports a patient. In another configuration in which accessory 10 and surgical table 22 support a patient similar to an Andrews table, section 128 is generally horizontal and section 130 extends generally upwardly from the end of section 128 that is opposite the end of section 128 that is coupled to section 126. In this alternative configuration, rail clamps 112 are still substantially parallel with accessory rail 114 of section 130 and are oriented generally vertically, but frame 12 extends from rail clamps 112 in a substantially horizontal orientation. Of course, section 130 may be inclined from vertical by some amount and frame 12 may be inclined from horizontal by some amount depending upon the preference of the surgeon.

Figure 15:
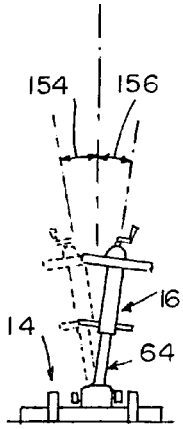
FIG. 15 is a diagrammatic view showing the ability of the telescopic support structure to tilt side to side relative to the base of the accessory.

In each of FIGS. 11-14 and 28, telescopic leg 64 is shown in a vertical orientation for ease of illustration. However, it will be appreciated that, assuming base 14 of accessory 10 remains stationary relative to base 124 of table 22, joint 66 permits telescopic leg 64 to pivot relative to base 14, either fore or aft of the vertical orientation, as indicated by double headed arrows 150, 152 in FIG. 11, to accommodate front to rear tilting movement of frame 12. In addition, joint 68 permits frame 12 to pivot relative to telescopic leg 64 either upwardly or downwardly. Furthermore, joint 66 permits telescopic leg 64 to pivot relative to base to one side or the other from the vertical orientation, as indicated by double headed arrows 154, 156 in FIG. 15, and joint 68 permits frame 12 to pivot relative to telescopic leg 64 to one side or the other. These compound pivoting movements of telescopic leg 64 relative to base 14, and of frame 12 relative to telescopic leg 64, compensate for the fact that frame 12 has a fixed length and the fact that the longitudinal axis about which the patient support sections of table 22 pivot side to side are not likely to be coincident with axis 82 (FIG. 8) about which frame 12 pivots side to side.

Joints 66, 68 are free floating multi-axis joints that are unconstrained from pivoting within their range of movements about respective axes 70, 74, 78, 82. In addition, the coupling between shafts 136 of frame 12 and rail clamps 112 attached to table 22 is also a free floating joint, albeit about a single axis 140. The free floating joints of accessory 10 allow frame 12 to simply follow the motion dictated by the powered movement of table 22, within the ranges of movement of these joints. In the illustrative embodiment, accessory 10 is configured to permit ±20 degrees of front to rear tilt of fame 12 and ±20 degrees of side to side tilt of fame 12. Accessory 10 and table 22 may be moved during surgery to any desired position, such as for example, moving between the upwardly flexed and downwardly flexed positions to make the spine more lordotic or more kyphotic to reduce or eliminate pinching of discs by the adjacent vertebrae.

As mentioned above, frame members 24 are radiolucent to permit x-ray images and fluoroscopic images to be taken during surgery. Patient support devices 34, 36, 38 are also substantially radiolucent to facilitate the taking of x-ray images and fluoroscopic images during surgery. Such images are often taken with a device having a C-arm that includes portions above and below a patient. Because base 14 of accessory 10 is separated from base 124 of table 22, there is a large unobstructed amount of floor space beneath frame 12 which enhances the positioning of imaging equipment, such as a C-arm, relative to a patient supported on accessory 10 and table 22. The imaging access afforded by accessory 10, when used in combination with a surgical table, is even more than that of a Jackson table which has one or more base frame members extending from one end of the Jackson table to the other in close proximity to the floor.

Referring now to FIGS. 16 and 17, hook portion 138 of rail clamp 112 has a first boss 158 that extends laterally outwardly from a first vertical surface 160 and a second boss 162 that extends laterally outwardly from a second vertical surface 164. A curved shaft support surface 166 is defined by bosses 158, 162 and part of hook portion 138 between bosses 158, 162. Shaft 136 rests upon surface 166 when accessory 10 is coupled to table 22. Shaft 136 rotatively slides on surface 166 when frame 12 is tilted relative to table 12 or when section 118 of table 22 is titled relative to frame 12, for example.

A collar 168 is mounted on shaft 136 and has first and second annular recesses 170, 172, shown best in FIGS. 20 and 21, which receive bosses 158, 162, respectively, to prevent inadvertent decoupling of frame 12 from the associated rail clamp 112. Collar 168 has an aperture 174 through which shaft 136 extends and collar 168 may be moved axially along shaft 136 to position collar 168 on one side of hook portion 138 of rail clamp 112 or the other as shown in FIGS. 20 and 21. Shaft 136 has suitable length to account for the fact that rail clamps 112 may be mounted to surgical tables having different widths. For wider surgical tables, it may be desirable for collar 168 to be located on shaft 136 between hook portion 138 and corner connector 32 and, for narrower surgical tables, it may be desirable for hook portion 138 to be located between collar 168 and corner connector 32.

A screw 176 having a knob 178 coupled thereto is threaded through a threaded opening 180 in collar 168. After collar 168 has been moved to a position either having boss 158 received in recess 170 of collar as shown in FIG. 21 or having boss 162 received in recess 172 as shown in FIG. 20, a knob 178 is turned in one direction to tighten screw 176 against a flat surface 182 of shaft 136. Of course, turning knob 178 in an opposite direction loosens screw 176 from surface 182 of shaft 136. A retaining collar 184 has an aperture 186 that receives a distal end of shaft 136 therein. A set screw 188 is threaded through a threaded opening 190 in collar 184 and tightened against flat surface 182 of shaft 136 to fasten collar 184 to shaft 136. Collar 184 serves as a retainer to prevent collar 168 from falling off of the end of shaft 136.

In addition to collars 168 which prevent shafts 136 from decoupling inadvertently from respective hook portions 138 of rail clamps 112, each rail clamp 112 has a latch 192 which is biased by a coil spring 194 into a locking position to retain the associated shaft 136 on hook portion 138 as shown in FIG. 19. Hook portion 138 has a slot 196 in which a vertical tab portion 198 of latch 192 is received. A dowel pin 200 extends through apertures 210 formed in hook portion 138 and through an aperture 212 formed in vertical tab portion to pivotably couple latch 192 to hook portion 138 of the associated rail clamp 112. Part of slot 196 is widened to create a generally cylindrical bore 197, shown in FIG. 16, in which spring 194 is received. A spring retainer 214 is also received in slot 196 and has a pocket 216, shown in FIG. 16, in which an upper end of spring 194 is received. Spring 194 is maintained in a state of compression between retainer 214 and a projection 218 of tab portion 198 of latch 192 as shown in FIG. 19. A pair of dowel pins 220 extend through respective apertures 222 formed in hook portion 138 and through associated apertures 224 formed in spring retainer 214 to fasten spring retainer 214 to hook portion 138 of the associated rail clamp 112.

Latch 192 has a finger tab portion 226 which is bent at approximately a right angle relative to vertical tab portion 198. Finger tab portion 226 of latch 192 is situated above hook portion 138 of rail clamp 112 and engages an upper surface thereof when latch 192 is in the locking position. Finger tab portion 226 extends laterally outwardly beyond vertical surface 164 of hook portion 138 by a slight amount which enables a user to place a finger beneath finger tab portion 226 to pull finger tab portion 226 upwardly thereby to pivot latch 192 about pin 200 from the locking position to a releasing position. As latch 192 moves from the locking position to the releasing position, spring 194 is further compressed between projection 218 and spring retainer 216.

After latch 192 is moved to the releasing position and after the associated collar 168 is slid on shaft 136 away from the respective rail clamp 112 so that neither of bosses 158, 162 are received in the associated recess 170, 172, frame 12 may be unhooked from rail clamps 112 such that shaft 136 is lifted up and off of shaft support surface 166. When frame 12 is being coupled to rail clamps 112, shaft 136 moves downwardly toward surface 166 and wipes against a cam edge 228 of latch 192 to pivot latch 192 out of the locking position toward the releasing position. Once shaft 136 clears cam edge 192, spring 194 automatically biases latch 192 back into the locking position to retain shaft on hook portion 138. Thus, in the illustrative embodiment, accessory 10 has redundant mechanisms to safely retain frame 12 on rail clamps 112, one mechanism being collar 168 and the other being latch 192. In other embodiments, one or the other of collar 168 and latch 192 may be omitted.

Each corner connector 32 has a bore 228, shown in FIG. 16, which receives a proximal end region of shaft 136. A pair of dowel pins 230 extend through respective apertures 232 formed in corner connector 32 and into respective apertures 234 formed in the proximal end region of shaft 136 to couple shaft to corner connector 32. Thus, each shaft 136 is fixed against rotation relative to the associated corner connector 32 by dowel pins 230. Each corner connector 32 also has first and second channels in which ends of frame members 24, 28, respectively, are received. Frame members 24, 28 comprise carbon fiber tubes 236 that are filled with a filler material 238, such as polyurethane foam along a majority of the length of tubes 236. However, aluminum blocks 240, one of which is shown in FIGS. 16 and 18, are received in each of the end regions of tubes 236 to provide additional structural rigidity in the area where tubes 236 couple to corner connectors 30, 32.

As shown in FIG. 18, a pair of dowel pins 242 extend through respective apertures 244 in tube 236, through respective apertures 246 in block 240, and into respective apertures 248 in corner connector 32. In addition, a screw 250 extends through an aperture 252 in corner connector 32 and is threaded into a threaded aperture 254 of block 240. A plate 256 is fastened to a bottom surface of corner connector 32 by a plurality of screws 258 that extend through respective apertures 260 in plate 256 and into associated threaded apertures (not shown) formed in corner connector 32. While the connection between one frame member 24 and one corner connector 32 has been shown in detail in FIG. 18, it should be understood that there are similar connections, using dowel pins 242 and screw 250, between frame member 26 and corner connector 32 and between frame members 24 and corner connectors 30. A pair of plates 262 which are smaller than plates 256 are coupled to the bottom surfaces of corner connectors 30 as shown, for example, in FIG. 3.

Figure 22:
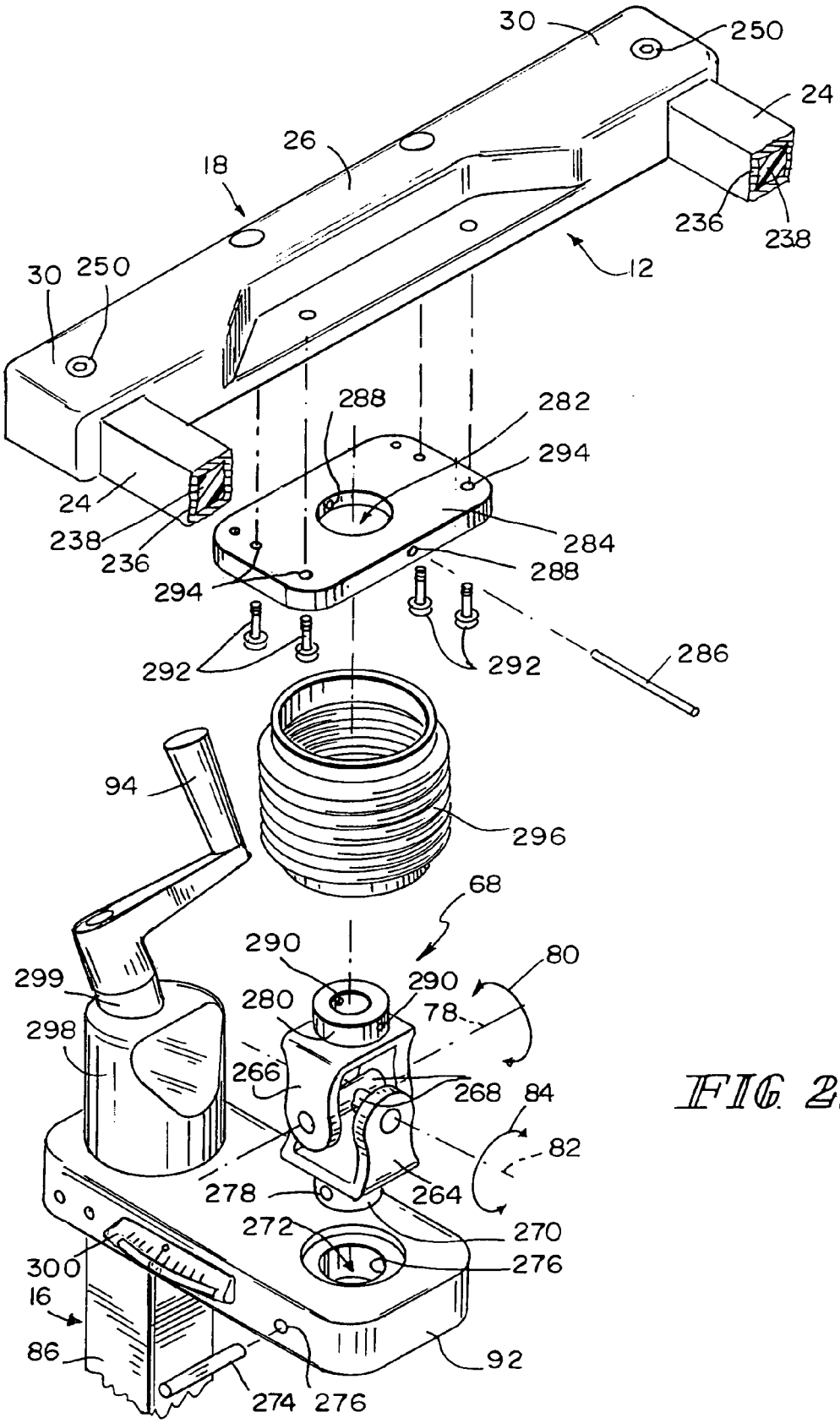
FIG. 22 is an exploded perspective of the details of a universal joint coupling between the first end of the frame and the telescopic support structure of the accessory.

Referring now to FIG. 22, the connection between first end 18 of frame 12 and support structure 16 is shown in more detail. Universal joint 68 includes a lower yoke 264 and an upper yoke 266 which are pinned together by mutually orthogonal pins 268 for pivoting movement about axes 78, 82. Lower yoke 264 has a cylindrical lower hub 270 which is received in a generally vertical cylindrical opening 272 formed in plate 92. A pin 274 extends through generally horizontal apertures 276 formed in plate 92 and through generally horizontal apertures 278, only one of which can be seen in FIG. 22, formed in hub 270 to couple yoke 264 to plate 92. Upper yoke 266 has a cylindrical upper hub 280 which is received in a generally cylindrical opening 282 formed in a plate 284. A pin 286 extends through apertures 288 formed in plate 284 and through apertures 290 formed in hub 280 to couple yoke 266 to plate 284. Plate 284 is coupled to a bottom surface of frame member 26 by a plurality of screws 292 which extend through respective apertures 294 in plate and which are threaded into threaded apertures (not shown) in frame member 26.

A middle portion of pin 274 is situated in hub 270 and end regions of pin 274 are situated in apertures 276 of plate 92 on opposite sides of hub 270 to prevent universal joint 68 from rotating out of its desired orientation having axis 82 extending generally parallel with the long dimension of plate 92 and having axis 78 extending generally parallel with the short dimension of plate 92. Similarly, a middle portion of pin 286 is situated in hub 280 and end regions of pin 286 are situated in apertures 288 on opposite sides of hub 280 to prevent universal frame 12 from rotating out of its desired orientation having frame member 26 extending generally perpendicular to the long dimension of plate 92. Joint 68 includes a bellows 296, which is made of rubber or other similarly flexible material, to shield yokes 264, 266. A lower end of bellows 296 is fastened to plate 92 and an upper end of bellows 296 is fastened to plate 284.

Offset from joint 68 toward the rear of plate 92 is a crank handle housing 298 which extends upwardly from plate 92 as shown in FIG. 22. Crank handle 94 is coupled to shaft 299 which extends upwardly out of housing 298 at an angle that is inclined relative to vertical. A pair of angle indicators 300, one of which can be seen in FIG. 22, are mounted to the sides of plate 92. Angle indicators 300, which are bubble level indicators in some embodiments, provide a visual indication of how much support structure 16 is tilted, front to rear, out of the vertical orientation.

Figure 23:
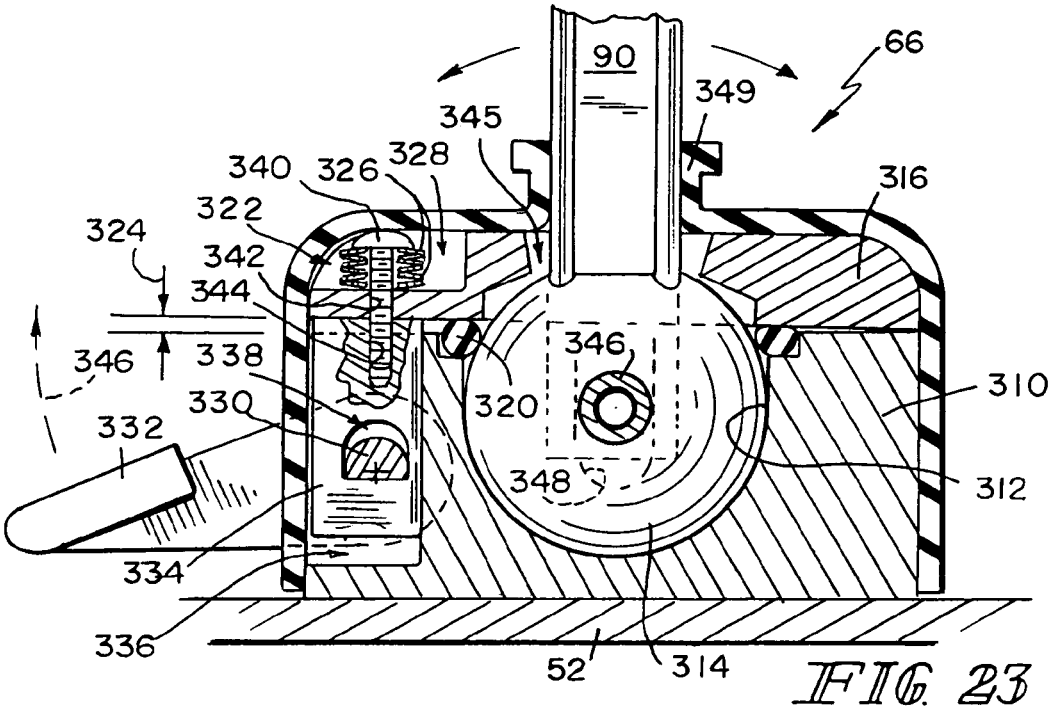
FIG. 23 is a sectional view of a ball joint coupling between a lower end of the telescopic support structure and the base of the accessory showing a majority of a ball of the ball joint received in a main housing, a housing cap above the main housing, an O-ring situated between the main housing and the housing cap and in contact with the ball, a set of flexible washers situated on the housing cap, a D-shaped cam coupled to the main housing, a follower coupled to the cam, and a screw extending through bores of the set of flexible washers and coupled to the follower and showing the cam in a first position having the O-ring clamped somewhat loosely against the ball.
Figure 24:
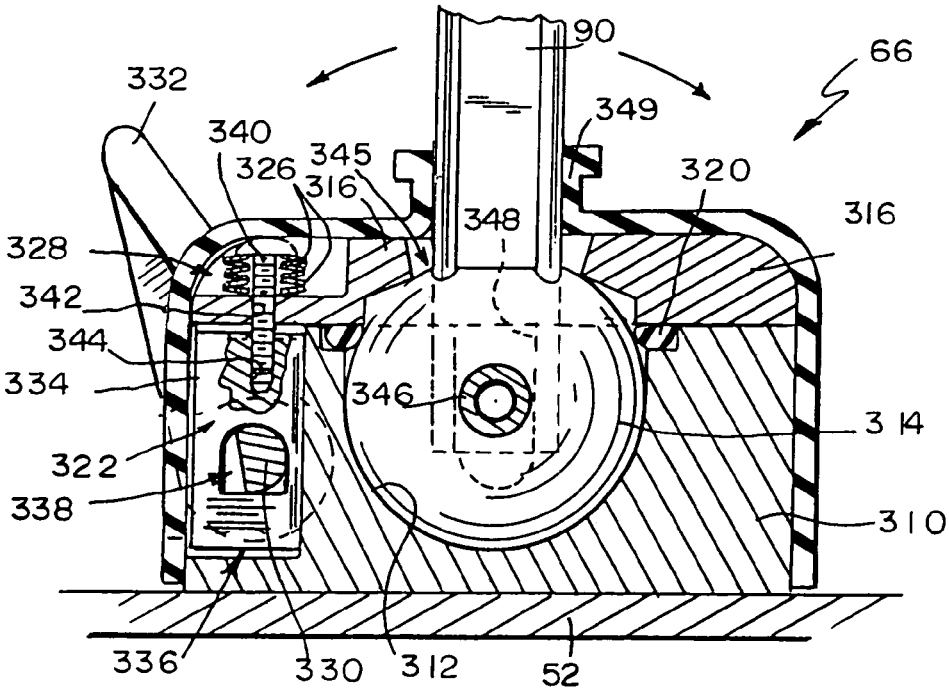
FIG. 24 is a sectional view, similar to FIG. 23, showing the cam rotated to a second position having the O-ring clamped more tightly against the ball thereby to tighten the ball joint such that a larger amount of torque is needed to rotate the ball joint.

Referring now to FIGS. 23 and 24, ball joint 66 is shown in more detail. Ball joint 66 comprises a main housing 310 having a generally spherical surface 312, a ball 314 supported by surface 314, and a housing cap 316 situated atop housing 310. An O-ring 320 is situated between main housing 310 and housing cap 316 and is in contact with ball 314. Housing 310 has an annular groove 318 in which a portion of the O-ring is received, but O-ring is larger than the groove 318 such that portion of the O-ring outside the groove are able to contact ball 314 and cap 316. A set of screws (not shown) couple main housing 310 to plate 52 of base 14. In addition, a pair of screws (not shown) couple the front end of cap 316, which is to the right in FIGS. 23 and 24, to main housing 310.

Joint 66 has an adjustable clamping assembly 322 which is movable to clamp O-ring 320 between housing cap 316 and main housing 310 by a varying amount which, in turn, squeezes O-ring 320 by a varying amount against ball 314 which, ultimately, adjusts the torque required to pivot ball 314 relative to housing 310. The upper surface of main housing 310 is slightly inclined such that, at the rear end of joint 66, which is to the left in FIGS. 23 and 24, a gap 324 exists between cap 316 and housing 310 when clamping assembly 322 is in a first position. Clamping assembly 322 is movable between the first position, shown in FIG. 23, and a second position, shown in FIG. 24. As clamping assembly 322 moves from the first position to the second position, the rear end of cap 316 is drawn downwardly toward the upper surface of housing 310 to close gap 324 thereby to provide the clamping effect on O-ring 320. Clamping O-ring 320 against ball 314 to tighten joint 66 may be desirable, for example, if accessory 10 is coupled to a surgical table having a noticeable amount of looseness between its patient support sections and its pedestal. Tightening joint 66, in such situations, helps to stabilize the overall accessory 10 and surgical table combination.

Clamping assembly 322 comprises a set of flexible washers 326 situated on the housing cap 316 in a pocket 328 formed therein. Assembly 322 also has a shaft 330 with a D-shaped middle region which serves as a cam (sometimes referred to herein as "cam 330") and which is coupled to housing 310. Shaft 330 also has end portions that extend beyond opposite sides of housing 310 and foot pedals 332 are coupled to the ends of shaft 330 as shown, for example in FIG. 3. The foot pedals 332 on opposite sides of housing 310 are mounted on shaft 330 in different orientations to provide users with different options for engaging pedals 332 with their feet. Assembly further includes a follower 334 that is coupled to the cam 330 and that is situated in a pocket 336 formed in main housing 310 as shown in FIGS. 23 and 24. Follower 334 has a D-shaped opening 338 in which cam 330 is received. In the illustrative embodiment, follower 334 is a generally vertically oriented rectangular plate-like element.

Assembly 322 also has a member 340 that extends through bores of the set of flexible washers 326 and that couple to follower 334. In the illustrative example, member 340 comprises a screw (sometimes referred to herein as "screw 340") that extends loosely through an aperture 342 formed in housing cap 316 and that is threaded into a threaded aperture 344 formed in follower 334. The set of flexible washers 326 are maintained in a state of compression between the head of screw 340 and housing cap 316. Movement of foot pedal 332 in the direction of arrow 346, shown in FIG. 23, rotates cam 330 which results in downward movement of follower 334 which, in turn, pulls screw 340 downwardly thereby further squeezing the set of flexible washers 326 against housing cap 316 resulting in an increase in the amount of force with which O-ring 320 is forced against ball 314 by housing cap 316.

A lower end of tube 90 of telescopic leg 64 is received in an opening that extends generally vertically within ball 314. A shaft 346 extends through a bore formed in ball 314 and through apertures formed in the lower end of tube 90 thereby to couple tube 90 to ball 314. The bore in ball 314 in which shaft 346 is received intersects the opening in ball 314 in which the lower end of tube 90 is received. Main housing 310 has a pair of grooves 348 that are formed on opposite sides of ball 314 and that are recessed relative to generally spherical surface 312. End regions of shaft 346 project beyond ball 314 and are received in respective grooves 348 to prevent ball 314 and support structure 16 from pivoting relative to base 14 along an axis defined along the length of telescopic leg 64. However, ball 314 is free to rotate front to rear about shaft 346 and ball 314 is free to rotate side to side. It should be appreciated that ends of shaft 346 will move upwardly and downwardly within respective grooves 348 when ball 314 rotates side to side which, in turn, changes the angle of shaft 346 relative to horizontal thereby changing the angle of the axis about which ball rotates front to rear. The size of an opening 345 in housing cap 316 dictates how much telescopic leg 64 is able to rotate front to rear and side to side. Joint 66 has a flexible cover 347 which extends over housing 310 and cap 316 and which has a neck portion 349 abutting and surrounding lower tube 90 above opening 345. Cover 347 is made of rubber or other similarly flexible material. As telescopic leg 64 tilts relative to base 14, cover 347 flexes with leg 64.

Figure 25:
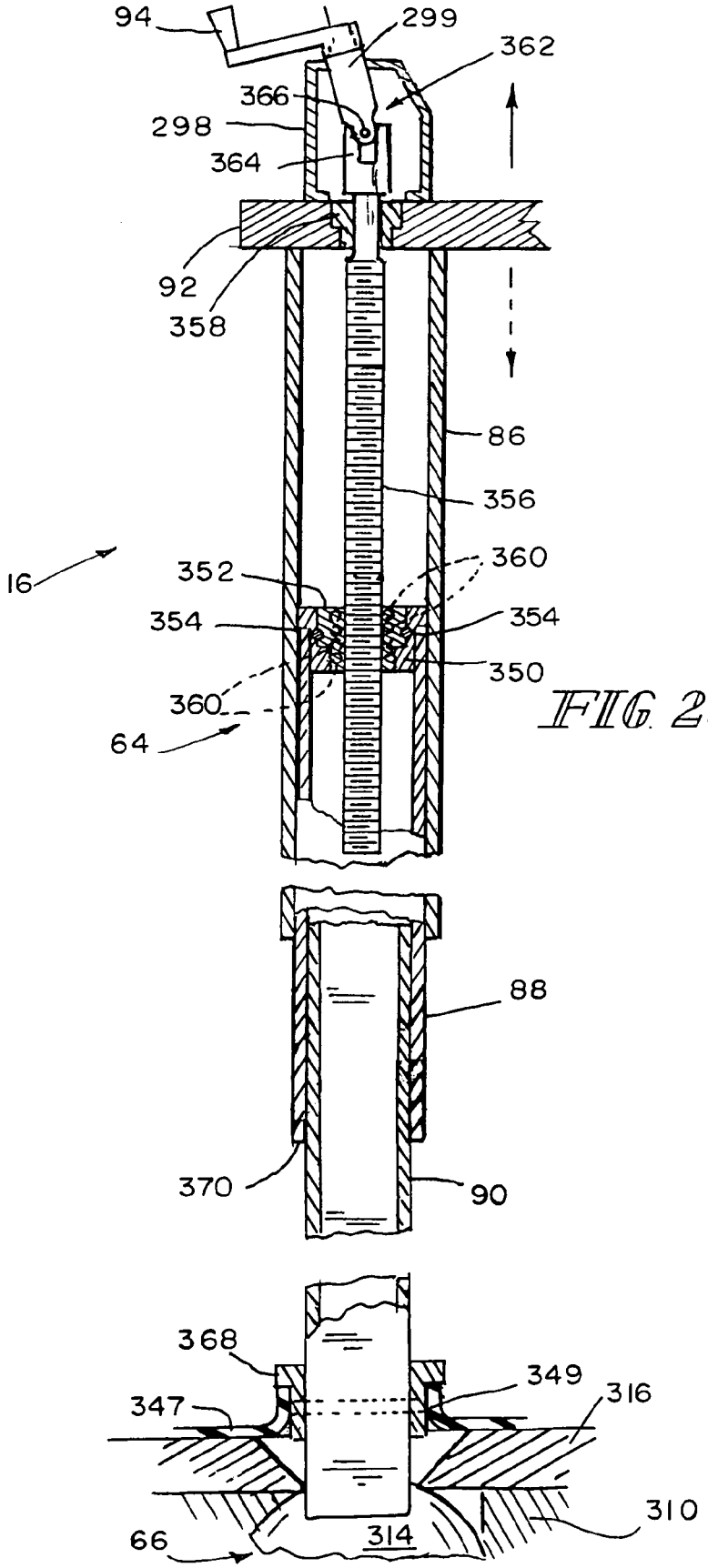
FIG. 25 is a sectional view through the telescopic support structure of the accessory showing a threaded ball screw extending within an upper tube of the support structure, a ball nut that is coupled to an upper end of a middle tube of the support structure and that has balls which ride in a helical ball track of the threaded screw, a lower tube of the telescopic support structure extending upwardly from the ball of the ball joint, the middle tube being freely movable along the lower tube, and a collar mounted to the lower tube above the ball so that, when the accessory is in use to support a patient, the lower end of the middle tube rests against the collar.

Referring now to FIG. 25, additional details of telescopic leg 64 are shown. A ball nut housing 350 is mounted to an upper end of middle tube 88 and a ball nut 352 is pinned to housing 350 with a pair of pins 354. A threaded shaft 356 is supported for rotation relative to plate 92 by a bearing 358. Shaft 356 extends downwardly from plate 92 through nut 352. Nut 352 has a set of balls 360 which ride in the threads of shaft 356. A universal joint 362 is situated in an interior region of crank handle housing 298 and has a lower yoke 364 coupled to an upper end of shaft 356 which projects upwardly beyond bearing 358 into housing 298 and an upper yoke 366 which is integral with crank handle shaft 299 to which crank handle 94 couples. Rotation of crank handle 94 is transmitted through universal joint 362 to shaft 356. Rotation of shaft 356 in one direction causes ball nut 354 to travel upwardly on shaft 356, thereby to retract middle tube 88 relative to upper tube 86, and rotation of shaft 356 in an opposite direction causes ball nut 354 to travel downwardly on shaft 356, thereby to extend middle tube 88 relative to upper tube 86. While telescopic leg 64 may be designed to have any desired length of extension and retraction, in the illustrative example tubes 86, 88 are able to extend and retract by an amount that adjusts the height of first end 18 of frame 12 by about 12 inches (about 30.5 cm) between a height of about 30 inches (about 76.2 cm) to a height of about 42 inches (about 1.1 m).

Middle tube 88 is freely slidable on lower tube 90. A collar 368 is fastened to lower tube 90 just above joint 66. When accessory 10 is coupled to a surgical table 22 for use, a bottom edge 370 of middle tube 88 rests upon collar 368 such that extension and retraction of tube 88 relative to tube 86 results in a change in elevation of first end 18 of frame 12 relative to base 14. However, when accessory 10 is being moved into the storage position, tubes 86, 88 are manually lifted upwardly such that tube 88 separates from collar 368 and slides upwardly relative to tube 90.

As discussed above, patient support devices, such as head support device 34, chest support device 36, and hip support device 38 are coupleable to frame members 24 of frame 12. While it is within the scope of this disclosure for frame members 24 to be of any desired size, shape, and spacing, in the illustrative embodiment, frame members 24 are quadrilateral in cross section having a width of about 1.25 inches (about 3.175 cm) and a height of about 1.5 inches (about 3.81 cm). Furthermore, in the illustrative embodiment, frame members 24 are spaced apart by about 14 inches (about 35.56 cm) as measured between the inside surfaces of the frame members (or, about 17.5 inches (about 44.45 cm) as measured between the outside surfaces of the frame members). By having frame members of this size, shape, and spacing, any device which would otherwise be attachable to a Jackson table, may be attached to frame members 24 of accessory 10.

Figure 26:
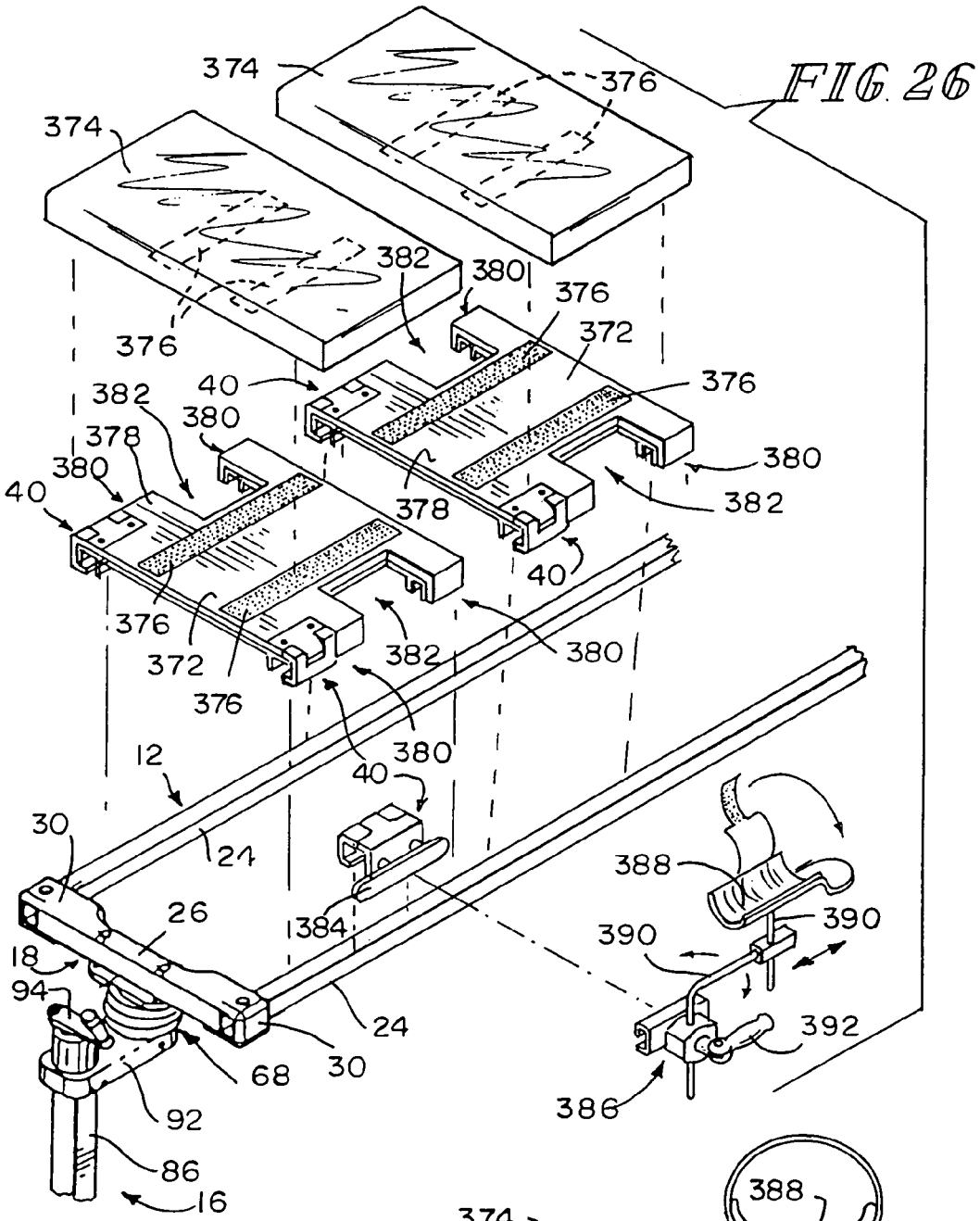
FIG. 26 is an exploded perspective view showing a pair of panels that are attachable to the frame to bridge the space between the side frame members, a pair of mattress pads above the panels, a clamp that is attachable to one of the side frame members in a notch provided in the panels, the clamp having an accessory rail, and an arm support accessory that is attachable to the accessory rail of the clamp.
Figure 27:
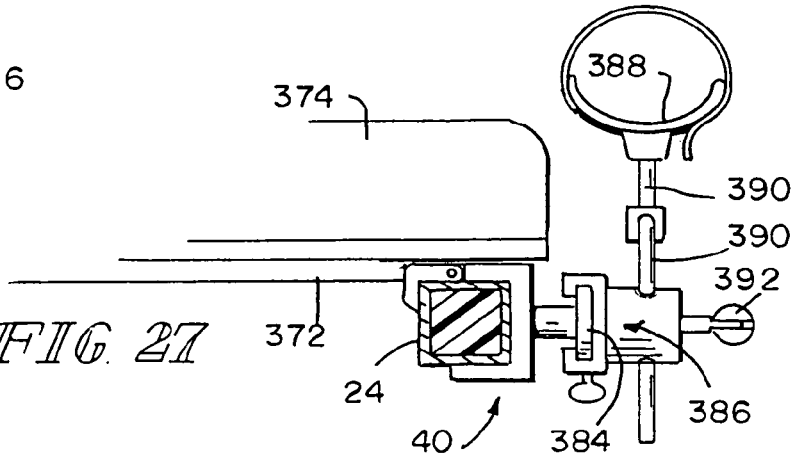
FIG. 27 is a fragmentary view showing one of the mattress pads supported on the associated panel and extending over the clamp.

Frame 12 has a large open space between frame members 24 which allows the abdomen of a patient to hang downwardly in an unobstructed manner when the patient is supported by devices 34, 36, 38. However, if desired, other types of devices may be attached to frame 12 in lieu of, or in addition to, devices 34, 36, 38. For example, one or more panels 372 may be attached to frame members 24 and one or more mattress pads 374 may be coupled to top surfaces of panels 372 as shown in FIGS. 26 and 27. Panels 372 and mattress pads 374 each have hook and loop fasteners strips 376 (e.g., VELCRO® strips), shown in FIG. 26, that intermesh when pads 374 are placed on panels 372 in the proper position.

Panels 372 each have a generally flat top plate 378 that spans across the space between frame members 24 of frame 12. Each panel 372 also has a set of channel members 380 extending downwardly from the ends of plate 378. Channel members 380 are sized to slip over frame members 24 with a minimal amount of clearance therebetween. Panels 372 further include integrated clamps 40 that are operable to grip frame members 24 to retain panels 372 in place on frame members 24. Clamps 40 of panels 372 are substantially the same as clamps 40 of devices 34, 36, 38 and so the same reference numeral is used.

The end region of each panel 372 has a notch 382 through which a portion of a respective frame member 24 is exposed when the associated panel 372 is coupled to frame members 24. Another clamp 40, similar to clamps 40 of devices 34, 36, 38 and panels 372 but having a short accessory rail 384, is coupleable to the portion of the frame member 24 exposed in any particular notch 382. An accessory rail clamp 386 is coupleable to the accessory rail 384. Accessory rail 384 has a cross section that is substantially the same as the cross sections of accessory rails 114 of table 22. Thus, any device configured to attach to accessory rails 114 of table 22 may also couple to the accessory rail 384 of the clamp 40 that is coupled to frame members 24 in notch 382. Of course, clamps 40 with accessory rails 384 may couple to frame members 24 at any point at which frame members 24 are exposed and need not necessarily be situated within notches 382 of panels 372. Panels similar to panels 372 but without notches 382 are also contemplated by this disclosure.

Illustratively, clamp 386 supports an arm board 388 via a series of rods 390 that extend between arm board 388 and clamp 386. However, other types of limb supports or other types of devices, may be coupled to clamp 386 in lieu of arm board 388. In the illustrative example, clamp 386 is substantially similar to the rail clamp shown and described in U.S. Pat. No. 6,633,980 which is assigned to the same assignee as the present application and which is hereby incorporated by reference herein. Thus, a handle 392 is rotatable to substantially simultaneously lock one of rods 390 relative to clamp 386 and to lock clamp 386 on accessory rail 384. As shown in FIG. 27, when one of mattress pads 374 is coupled to an associated panel 372 having clamp 40 with accessory rail 384 in one of its notches 382, a portion of the mattress pad 374 overlies and rests atop the corresponding notch 382 and the clamp 40. However, rail 386 is situated outside the footprint of the associated mattress pad 372 so that devices, such as clamp 386 may be coupled thereto without obstruction from mattress pad 372.

Figure 29:
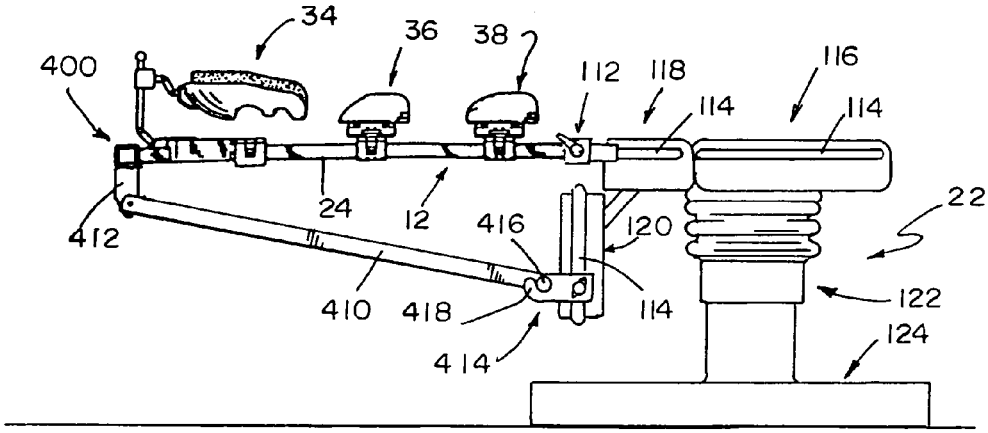
FIG. 29 is a side elevation of another accessory showing a proximal end of a frame of the accessory attached to a first rail clamp that is fastened to a generally horizontal section of a surgical table, a second rail clamp that is fastened to a generally vertical section of the surgical table, and a strut extending beneath the frame between a distal end of the frame and the second rail clamp.

Referring now to FIG. 29, an alternative embodiment of an accessory 400 is coupled to surgical table 22. Portions of accessory 400 that are substantially the same as like portions of accessory 10 are denoted with like reference numerals. For example, accessory 400 has a frame 12 with spaced frame members 24, only one of which can be seen in FIG. 29, that couple to accessory rails 114 of table 22 with rail clamps 112. However, unlike accessory 10, accessory 400 does not have a base 14 or support structure 16. Instead, accessory 400 has a pair of support struts 410, each of which is situated generally vertically beneath a respective frame member 24 and each of which extend from a respective link 412 to a respective rail clamp 414. Struts 410 are able to pivot relative to clamps 414 and links 412 to accommodate the position of clamps 414 on the associated accessory rails 114 of table 22 and to permit section 120 to be in an orientation other than generally vertical when frame 12 is substantially horizontal. It should be appreciated, however, that once clamps 414 are fastened to rails 114, struts 410 maintain there orientations relative to links 412 and frame 12.

In the illustrative example, clamps 112 of accessory 400 are coupled to accessory rails 114 of section 118 of table 22 and clamps 414 are coupled to accessory rails 114 of section 120, which is moved downwardly relative to section 118 into a generally vertical position. In other configurations, section 120 may be inclined from vertical by some amount when frame 12 is in its horizontal orientation. Rail clamps 414 are similar to rail clamps 112, but are configured to be perpendicular to accessory rails 114 when coupled thereto, rather than being parallel to accessory rails 114 as is the case with rail clamps 112. A pivot shaft 416 extends from each strut and are coupled to a hook portion 418 of each clamp 414 in substantially the same manner as pivot shafts 136 are coupled to hook portions 138 of clamps 112. Powered movement of section 120 relative to section 118 results in frame 12 pivoting upwardly or downwardly relative to clamps 112 and section 118. Sections 118, 116 of surgical table may be inclined about a lateral axis thereby to move accessory 400 and table 22 in to an upwardly flexed position or downwardly flexed position. In addition, sections 116, 118, 120 may be powered to tilt about a horizontal axis and frame 12 will tilt side to side with sections 116, 118, 120.

While illustrative accessory 10 has been described above as coupling to accessory rails 114 of surgical table 22 via pivot shafts 132 and rail clamps 112, in other embodiments frame 12 and/or frame members 24 may couple to surgical tables 22 with other mechanisms. The same can be said of accessory 400. Different surgical table manufacturers have different types of connectors for coupling removable table sections to other portions of the surgical table. Surgical tables may have, for example, posts, ports, sockets, spades, and the like, as coupling mechanisms. It is within the scope of this disclosure for accessory 10 or accessory 400 to have couplers that mate with the posts, ports, sockets, spades, etc., as the case may be, of an associated surgical table. It should further be appreciated that while, accessory 10 and accessory 400 have been described herein as being "accessories" that attach to surgical tables, it is within the scope of this disclosure for these devices or portions thereof, such as frame 12 and/or frame members 24, to be integrated with, and therefore, be considered part of a surgical table itself. That is, frame 12 and/or frame members 24, may serve as a surgical table section that attaches to one or more other surgical table sections by any suitable coupler, such as those discussed herein.

Figure 30:
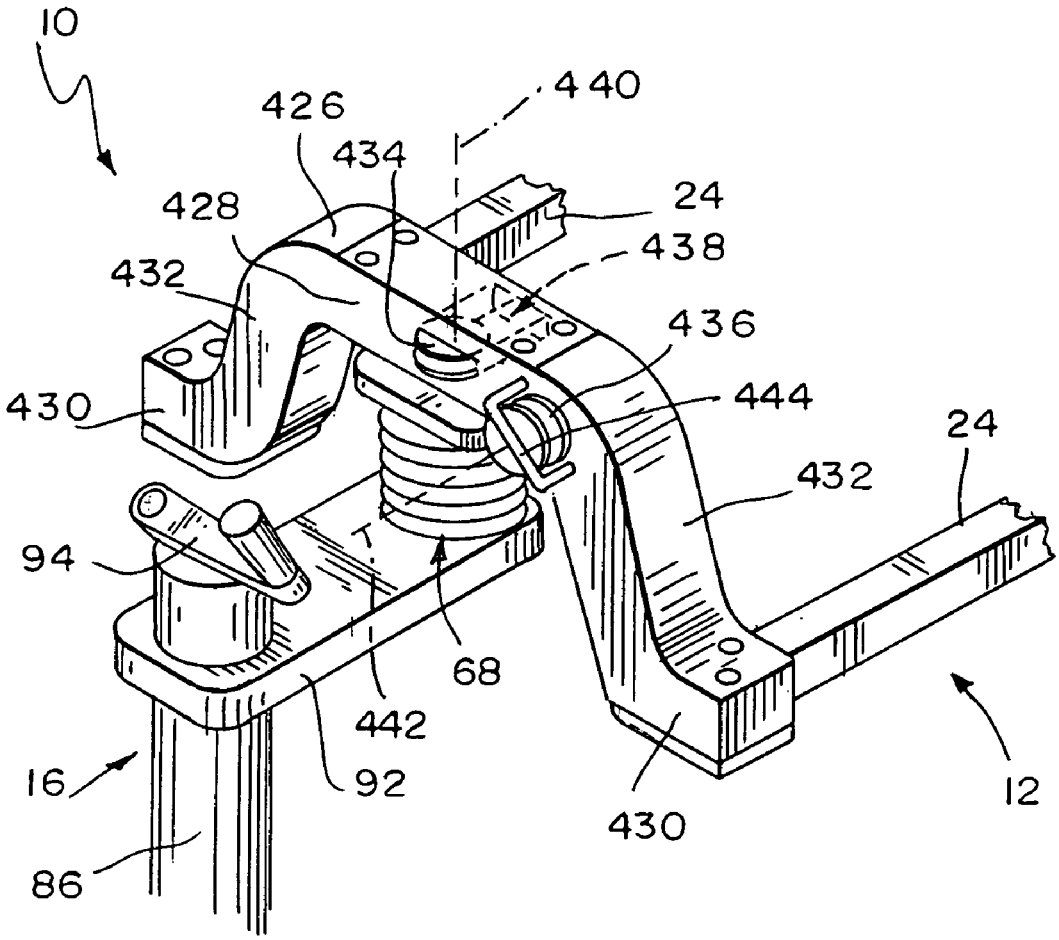
FIG. 30 is a perspective view of yet another accessory having a frame including a cross member with end regions that, when in use, are at lower elevations than a central region of the cross member and showing pulleys for use with cervical traction equipment attached to the cross member.

Referring now to FIG. 30, accessory 10 has an alternative head end frame member 426. Other than frame member 426, all other aspects of accessory 10 of FIG. 30 are substantially the same as accessory 10 of FIGS. 1-28. Frame member 426 has a central portion 428 coupled to joint 68 and lowered end portions 430 that couple to frame members 24. Frame member 426 also has transition portions 432 that slope downwardly and outwardly from central portion 426 to respective end portions 430. Thus, at any particular length of telescopic leg 64 of support structure 16, end portions 430 of frame member 426 support frame members 24 at a lower elevation in the FIG. 30 embodiment of accessory 10 than does frame member 26 of the FIG. 1-28 embodiment of accessory 10.

A first pulley 434 and a second pulley 436 are coupled to frame member 426 and are used for routing cables or ropes that are associated with surgical traction equipment (not shown), for example. A portion of pulley 434 is received in a slot 438 that is formed front-to-rear through frame member 426. Pulley 434 is supported relative to frame member 426 for rotation about a first axis 440 which is generally perpendicular to the direction of frame members 24 and pulley 436 is supported for rotation relative to frame member 426 about a second axis 442 which is generally parallel with the direction of frame members 24. A bail 444 extends over pulley 436 as shown in FIG. 40. A rope may be routed from the cervical traction equipment, for example, through slot 438, over pulley 434, and over pulley 436. Side segments of bail 444 may contact the rope with sufficient friction to hold the rope taut.

Additionally or alternatively, weights may be hung on a portion of the rope hanging downwardly from pulley 436. Because frame members 24 are supported by end portions 430 of frame member 426 at a lower elevation than pulley 434, pulley 434 is generally horizontally aligned with the crown of a patient's head which allows the rope to apply a generally horizontal force to the cervical traction equipment attached to the patient's head.

Although certain illustrative embodiments have been described in detail above, variations and modifications exist within the scope and spirit of this disclosure as described and as defined in the following claims.

The invention claimed is:

1. An accessory for attachment to a surgical table to support an upper body of a patient during surgery, the surgical table having longitudinally extending accessory rails that are situated on opposite sides of the surgical table, the accessory comprising a pair of spaced radiolucent frame members to which patient support devices are coupleable, and a coupler to freely pivotably couple the pair of spaced radiolucent frame members to the surgical table such that the pair of spaced radiolucent frame members extend longitudinally away from the surgical table and are able to articulate relative to the surgical table in response to portions of the surgical table being moved, the coupler including a pair of clamps that are configured to simultaneously attach to the longitudinally extending accessory rails that are situated on opposite sides of the surgical table, wherein the pair of spaced radiolucent frame members are configured and arranged such that the upper body of the patient is supportable thereabove and at least a portion of the legs of the patient are supportable by the surgical table during surgery, wherein the coupler comprises a pair of pivot shafts that extend generally horizontally from the frame members, wherein each clamp has a shaft support to support the shaft for pivoting movement about a generally horizontal axis, wherein each clamp has a boss that extends from the respective shaft support, the coupler further comprises a pair of collars, each collar being mounted on the respective pivot shaft and having a recess, each collar being movable along the respective shaft between a first position in which the respective boss is received in the associated recess to prevent the pivot shaft from being removed from the corresponding clamp and a second position in which the respective boss is situated outside the associated recess, and the coupler comprises a pair of threaded screws, each threaded screw coupled to the respective collar and movable to tighten against the associated pivot shaft to retain the respective collar in place on the associated pivot shaft.

2. The accessory of claim 1, wherein each of the radiolucent frame members comprises a carbon fiber tube and a filler material within the tube.

3. The accessory of claim 2, wherein the filler material comprises a polyurethane foam material.

4. The accessory of claim 1, wherein each clamp comprises a block with a channel sized to receive the respective accessory rail of the surgical table and the shaft support comprises a hook extending from the block, the hook having a curved surface on which the respective pivot shaft rests.

5. The accessory of claim 1, wherein each clamp includes a latch that is movable between a first position preventing the respective pivot shaft from being removed from the clamp and a second position allowing removal of the respective pivot shaft from the clamp.

6. The accessory of claim 1, further comprising a pair of retainers, each retainer being adjacent an end of the respective pivot shaft to prevent the associated collar from being removed from the respective pivot shaft.

7. The accessory of claim 1, further comprising a pair of connector blocks, each connector block is fastened to an end region of the respective frame member and each pivot shaft is fastened to the respective connector block.

8. The accessory of claim 7, wherein each connector block has a channel in which the end region of the corresponding frame member is received and a bore in which a portion of the corresponding pivot shaft is received.

9. The accessory of claim 8, wherein each channel extends in perpendicular relation to the associated bore.

10. An accessory for attachment to a surgical table to support an upper body of a patient during surgery, the surgical table having longitudinally extending accessory rails that are situated on opposite sides of the surgical table, the accessory comprising a pair of spaced radiolucent frame members to which patient support devices are coupleable, a coupler to freely pivotably couple the pair of spaced radiolucent frame members to the surgical table such that the pair of spaced radiolucent frame members extend longitudinally away from the surgical table and are able to articulate relative to the surgical table in response to portions of the surgical table being moved, the coupler including a pair of clamps that are configured to simultaneously attach to the longitudinally extending accessory rails that are situated on opposite sides of the surgical table, wherein the pair of spaced radiolucent frame members are configured and arranged such that the upper body of the patient is supportable thereabove and at least a portion of the legs of the patient are supportable by the surgical table during surgery, wherein the coupler comprises a pair of pivot shafts that extend generally horizontally from the frame members, a pair of connector blocks, each connector block is fastened to an end region of the respective frame member and each pivot shaft is fastened to the respective connector block, and a radiolucent cross frame member extending between the pair of spaced radiolucent frame members and the cross frame member is also fastened to the pair of connector blocks.

11. The accessory of claim 10, wherein each connector block has a first channel in which the end region of the respective frame member is received, a second channel in which an end region of the cross frame member is received, and a bore in which a portion of the respective pivot shaft is received.

12. An accessory that is attachable to a surgical table to support a patient during surgery and detachable from the surgical table for storage, the accessory comprising a frame having a pair of substantially parallel, elongated radiolucent frame members to which patient support devices are coupleable, the frame having a first end and a second end, the frame being configured such that the upper body of the patient is supportable thereabove during surgery, a base, and a support structure having a lower end region coupled to the base and extending upwardly therefrom, the first end of the frame being coupled to an upper end region of the support structure, the frame and support structure being foldable between a compact storage position and a use position, the second end of the frame being spaced further from the base when in the use position than when in the storage position, wherein the base includes a base frame and a pair of hooks extending from the base frame, the frame has a pair of pivot shafts extending outwardly relative to the elongated radiolucent frame members at the second end of the frame, the pair of pivot shafts resting on the hooks when the frame is in the storage position.

13. The accessory of claim 12, wherein the base frame is generally U-shaped and the hooks extend from ends of the U-shaped base frame.

14. The accessory of claim 12, further comprising a pair of rail clamps that are coupleable to the surgical table and the pair of pivot shafts are coupleable to the rail clamps when the frame is in the use position.

15. An accessory that is attachable to a surgical table to support a patient during surgery and detachable from the surgical table for storage, the accessory comprising a frame having a pair of substantially parallel, elongated radiolucent frame members to which patient support devices are coupleable, the frame having a first end and a second end, the frame being configured such that the upper body of the patient is supportable thereabove during surgery, a base supported upon a floor, and a support structure having a lower end region coupled to the base and extending upwardly therefrom, the first end of the frame being coupled to an upper end region of the support structure by a first multi-axis joint configured to permit pivoting movement of the frame relative to the support structure about a first plurality of axes, the frame and support structure being foldable between a compact storage position and a use position, the second end of the frame being spaced further from the base when in the use position than when in the storage position, the second end of the frame being coupleable to the surgical table when in the use position.

16. The accessory of claim 15, wherein the support structure is coupled to the base by a second multi-axis joint.

17. The accessory of claim 15, wherein the support structure is extendable and retractable to change an elevation of the first end of the frame relative to the base.

18. The accessory of claim 17, wherein the support structure comprises a telescopic leg and a jack screw that is operable to extend and retract the telescopic leg.

19. The accessory of claim 15, further comprising a set of wheels supported with respect to the frame and the base, the wheels being spaced from a floor when the frame and support structure are in the use position, and the wheels being engageable with the floor when the frame and the support structure are in the storage position.

20. The accessory of claim 19, further comprising a handle coupled to the support structure and the handle being grippable to tip the base, the support structure, and the frame for transport having the wheels engaging the floor.

21. The accessory of claim 20, wherein the handle comprises a horizontal bar having gripping portions on opposite sides of the support structure.

22. An accessory that is attachable to a surgical table to support a patient's upper body during surgery, the accessory comprising a frame having a pair of substantially parallel, elongated radiolucent frame members, the frame being coupleable to the surgical table for pivoting movement relative to the surgical table about an axis, the frame being configured such that the upper body of the patient is supportable thereabove during surgery, a base which is supportable on a floor during surgery, and a support structure extending upwardly from the base, a first multi-axis joint coupling a lower region of the support structure to the base, the first multi-axis joint being configured to permit pivoting movement of the support structure relative to the base about a first plurality of axes, and a second multi-axis joint coupling an upper region of the support structure to the frame, the second multi-axis joint being configured to permit pivoting movement of the frame relative to the support structure about a second plurality of axes.

23. The accessory of claim 22, wherein the first multi-axis joint comprises a ball joint.

24. The accessory of claim 23, wherein an amount of torque to pivot the ball joint is adjustable.

25. The accessory of claim 24, wherein the torque to pivot the ball joint is adjustable by clamping an O-ring against a ball of the ball joint.

26. The accessory of claim 24, wherein the ball joint comprises a foot pedal that is movable to adjust the torque required to pivot the ball joint.

27. The accessory of claim 24, wherein the ball joint comprises a main housing having a generally spherical surface, a ball supported by the generally spherical surface, a housing cap, an O-ring situated between the main housing and the housing cap and in contact with the ball, an adjustable clamping assembly to clamp the O-ring between the housing cap and main housing.

28. The accessory of claim 27, wherein the clamping assembly comprises a set of flexible washers situated on the housing cap, a cam coupled to the main housing, a follower coupled to the cam, and a member extending through bores of the set of flexible washers and coupled to the follower such that movement of the cam results in movement of the follower which acts through the member to adjust an amount by which the set of flexible washers are squeezed thereby to adjust an amount of force with which the O-ring is forced against the ball by the housing cap.

29. The accessory of claim 23, wherein the support structure is elongated and defines an axis and wherein the ball joint comprises a ball, a main housing having a generally spherical surface on which the ball is supported, the main housing having at least one groove that is recessed relative to the generally spherical surface, and a shaft that extends through a bore formed in the ball, the shaft having opposite ends that project beyond the ball and that are received in the groove to restrict pivoting of the ball along an axis that is parallel with the axis defined by the support structure.

30. The accessory of claim 29, wherein the ball has an opening that intersects the bore, the support structure comprises a lower segment that is received by the opening, and the shaft that extends through the bore of the ball also couples the lower segment of the support structure to the ball.

31. The accessory of claim 22, wherein the second multi-axis joint comprises a universal joint.

32. The accessory of claim 31, wherein the support structure comprises a telescopic arm and a cantilevered member extending from an upper region of the telescopic arm, and wherein the universal joint is coupled to the cantilevered member so as to be offset from the telescopic arm.

33. The accessory of claim 32, wherein the support structure comprises a hand crank that is coupled to the cantilevered member and that is rotated in first and second directions to extend and retract, respectively, the telescopic arm.

34. The accessory of claim 32, wherein the universal joint comprises a first yoke fixed to the cantilevered member, a second yoke coupled to the first yoke for pivoting movement about a pair of perpendicular axes, and a plate fixed to the second yoke, and wherein the frame comprises a cross member that spans between the pair of radiolucent frame members and that is coupled to the plate.

35. The accessory of claim 34, further comprising a flexible cover to shield the universal joint, the flexible cover having a first end secured to the cantilevered member and a second end secured to the plate.

36. The accessory of claim 32, further comprising an angle indicator mounted to the cantilevered member, the angle indicator providing a visual indication of the angle of inclination of the frame relative to horizontal.

* * * * *